US010184419B2

(12) United States Patent
Tofukuji et al.

(10) Patent No.: US 10,184,419 B2
(45) Date of Patent: Jan. 22, 2019

(54) COOLING DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Satoko Tofukuji, Tokyo (JP); Yoshihiro Furuya, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 54 days.

(21) Appl. No.: 15/188,427

(22) Filed: Jun. 21, 2016

(65) Prior Publication Data

US 2016/0377022 A1 Dec. 29, 2016

(30) Foreign Application Priority Data

Jun. 23, 2015 (JP) ..... 2015-125568

(51) Int. Cl.
*F02F 1/10* (2006.01)
*F01P 3/02* (2006.01)
*F01P 3/14* (2006.01)

(52) U.S. Cl.
CPC ..... *F02F 1/10* (2013.01); *F01P 3/02* (2013.01); *F01P 3/14* (2013.01); *F01P 2003/027* (2013.01); *F01P 2037/02* (2013.01); *F01P 2060/08* (2013.01)

(58) Field of Classification Search
CPC ..... F02F 1/10; F01P 3/02; F01P 3/14; F01P 2037/02; F01P 2060/08
USPC ..... 123/41.82 R
See application file for complete search history.

(56) References Cited

U.S. PATENT DOCUMENTS 5,337,704 A * 8/1994 Roth ..... F01P 7/165 123/41.1
2003/0188714 A1* 10/2003 Yamamoto ..... F02D 35/023 73/114.09
2008/0245068 A1* 10/2008 Bastawros ..... F03G 7/00 60/530

(Continued)

FOREIGN PATENT DOCUMENTS

CN 104564301 A 4/2015
EP 1035306 A2 9/2000

(Continued)

*Primary Examiner* — Joseph Dallo
*Assistant Examiner* — Yi-Kai Wang
(74) *Attorney, Agent, or Firm* — Hunton Andrews Kurth LLP

(57) ABSTRACT

A cooling device for an internal combustion engine includes a HT cooling system, a LT cooling system, and an electronic control unit. The electronic control unit is configured to, if a HT temperature has reached a HT determination value, control an operation state of the HT cooling system to start cooling for maintaining the HT temperature at a HT target temperature. The electronic control unit is configured to, if a LT temperature being a temperature of a LT cooling medium has reached a LT determination value, start a LT cooling control for maintaining the LT temperature at a LT target temperature under a specific condition where an early warm-up of the internal combustion engine is not required. The electronic control unit is configured to start the LT cooling control if the HT temperature has reached the HT determination value under a condition where the early warm-up is required.

9 Claims, 22 Drawing Sheets

(56) References Cited

U.S. PATENT DOCUMENTS

| | | | | |
|---|---|---|---|---|
| 2009/0088957 | A1* | 4/2009 | Yamada | F02P 5/1521<br>701/111 |
| 2013/0047940 | A1* | 2/2013 | Quix | F01P 7/165<br>123/41.08 |
| 2013/0160723 | A1* | 6/2013 | Miyagawa | F01P 7/16<br>123/41.1 |
| 2013/0247848 | A1* | 9/2013 | Takahashi | F01P 3/02<br>123/41.82 R |
| 2014/0209046 | A1* | 7/2014 | Steiner | F01P 5/10<br>123/41.31 |
| 2015/0101549 | A1* | 4/2015 | Bilancia | F01P 1/06<br>123/41.31 |

FOREIGN PATENT DOCUMENTS

| | | | |
|---|---|---|---|
| JP | S63-97823 | A | 4/1988 |
| JP | 2013-060819 | A | 4/2013 |
| JP | 2013-133746 | A | 7/2013 |

* cited by examiner

FIG. 2

COMPARATIVE EXAMPLE

| LT | HT |
|---|---|
| INDEPENDENTLY LT TEMPERATURE ≥ LT DETERMINATION VALUE | INDEPENDENTLY HT TEMPERATURE ≥ HT DETERMINATION VALUE |

FIRST EMBODIMENT

| | LT | | HT |
|---|---|---|---|
| | HT HAS REACHED A DETERMINATION VALUE EARLIER | LT HAS REACHED A DETERMINATION VALUE EARLIER | |
| EARLY WARM-UP REQUIREMENT | COOPERATION (ADVANCED) | COOPERATION (DELAYED) | INDEPENDENTLY HT TEMPERATURE ≥ HT DETERMINATION VALUE |
| | HT TEMPERATURE ≥ HT DETERMINATION VALUE | | |
| KNOCK SUPPRESSION REQUIREMENT | COOPERATION (ADVANCED) HT TEMPERATURE ≥ HT DETERMINATION VALUE | INDEPENDENTLY LT TEMPERATURE ≥ LT DETERMINATION VALUE | |
| NO REQUIREMENT | INDEPENDENTLY LT TEMPERATURE ≥ LT DETERMINATION VALUE | | |
| INTERFERENCE OF REQUIREMENTS | CONDITION FOR EARLY WARM-UP REQUIREMENT | | |

COOLING DEVICE FOR INTERNAL COMBUSTION ENGINE

INCORPORATION BY REFERENCE

The disclosure of Japanese Patent Application No. 2015-125568 filed on Jun. 23, 2015 including the specification, drawings and abstract is incorporated herein by reference in its entirety.

BACKGROUND OF THE INVENTION

1. Field of the Invention

Embodiments of the present invention relate to a cooling device for an internal combustion engine and, in particular, relate to a cooling device suitable for cooling an on-vehicle internal combustion engine.

2. Description of Related Art

Japanese Patent Application Publication No. 2013-133746 (JP 2013-133746 A) discloses a cooling device for an internal combustion engine. This cooling device includes a first cooling water circuit for cooling the peripheries of intake ports of the internal combustion engine and a second cooling water circuit for cooling a cylinder block and the peripheries of exhaust ports of the internal combustion engine. The first cooling water circuit and the second cooling water circuit are formed as circuits that are independent of each other.

The first cooling water circuit includes an electric pump for circulating cooling water through the inside thereof and a first radiator for air-cooling the cooling water. The second cooling water circuit includes a second radiator for air-cooling cooling water circulating through the inside thereof and a thermostat that switches the circulation path of the cooling water. The thermostat circulates the cooling water so as to bypass the second radiator until the cooling water temperature reaches a threshold value H0, while the thermostat switches the circulation path such that the cooling water circulates through the second radiator when the cooling water temperature has reached the threshold value H0.

JP 2013-133746 A discloses that when the cooling water temperature of the second cooling water circuit has reached a threshold value H1, the electric pump of the first cooling water circuit is driven and that the threshold value H1 is set to a value different from the threshold value H0 of the thermostat. According to this configuration, the cooling water temperature of the first cooling water circuit and the cooling water temperature of the second cooling water circuit can be controlled at temperatures different from each other.

The temperature of the peripheries of the intake ports largely affects the temperature of intake air and the temperature of the intake air largely affects the charging efficiency of air and the occurrence of knocking. On the other hand, the temperature of the periphery of the cylinder block largely affects the friction loss of the internal combustion engine. Therefore, in the internal combustion engine, it is desirable to properly cool the peripheries of the intake ports without excessively cooling the periphery of the cylinder block. According to the above-mentioned conventional cooling device, it is possible to respond to such a requirement and thus to create an environment advantageous for both the improvement of fuel consumption and the prevention of knocking.

SUMMARY

The cooling capacity desired for the peripheries of the intake ports of an internal combustion engine is not always uniquely determined with respect to the cooling water temperature of the second cooling water circuit, i.e. the temperature of the periphery of the cylinder block. For example, in the warm-up process, the relative temperature rise rate of the peripheries of the intake ports to the temperature rise rate of the cylinder block changes depending on the operating conditions of the internal combustion engine.

Assuming that the peripheries of the intake ports rise in temperature earlier than the cylinder block, the start of cooling the peripheries of the intake ports is delayed with the above-mentioned conventional cooling device so that a state in which knocking tends to occur is created in the latter half of the warm-up. This problem can be solved by, for example, incorporating a cooling water temperature sensor also in a first cooling water circuit and driving an electric pump of the first cooling water circuit at a stage where the temperature of the cooling water flowing around the intake ports has reached an appropriate threshold value.

However, according to this configuration, then, a situation can occur in which the warm-up of the body of the internal combustion engine is delayed due to cooling by the first cooling water circuit. That is, although the first cooling water circuit mainly cools the peripheries of the intake ports, when the peripheries of the intake ports are cooled, its effect extends also to the periphery of the cylinder block due to heat conduction to some extent. Therefore, particularly in the state where early warm-up of the internal combustion engine is desired, it is desirable to refrain from cooling the peripheries of the intake ports until the periphery of the cylinder block is warmed up to some extent.

Embodiments of the invention provide a cooling device that includes a system for mainly cooling a cylinder block and a system for mainly cooling the peripheries of intake ports and that can properly switch a cooling environment of an internal combustion engine according to a requirement imposed on the internal combustion engine.

A cooling device for an internal combustion engine according to one embodiment of the invention includes a HT cooling system, a LT cooling system, and an electronic control unit. The HT cooling system mainly cools a cylinder block of the internal combustion engine. The LT cooling system mainly cools the periphery of an intake port compared to the HT cooling system. The LT cooling system and the HT cooling system have cooling medium flow passages independent of each other. The electronic control unit is configured to, if a HT temperature being a temperature of a HT cooling medium flowing in the HT cooling system has reached a HT determination value, control an operation state of the HT cooling system to start cooling for maintaining the HT temperature at a HT target temperature. The electronic control unit is configured to, if a LT temperature being a temperature of a LT cooling medium flowing in the LT cooling system has reached a LT determination value, start a LT cooling control for maintaining the LT temperature at a LT target temperature under a specific condition where early warm-up of the internal combustion engine is not required. The electronic control unit is configured to start the LT cooling control if the HT temperature has reached the HT determination value under a condition where the early warm-up of the internal combustion engine is required.

According to the cooling device for an internal combustion engine according to this embodiment, the cylinder block can be maintained around the HT target temperature by the HT cooling system and the periphery of the intake port can be maintained around the LT target temperature by the LT cooling system. Particularly, under the specific condition where the early warm-up of the internal combustion engine is not required, the occurrence of knocking can be properly suppressed by starting the LT cooling control based on the LT temperature regardless of the HT temperature. Under the condition where the early warm-up of the internal combustion engine is required, the following two effects can be achieved by starting the LT cooling control when the HT temperature has reached the HT determination value. (1) Even if the LT temperature has reached the LT determination value, the LT cooling control is not started until the HT temperature reaches the HT determination value. That is, by delaying the start of the LT cooling control until the warm-up of the body of the internal combustion engine progresses sufficiently, the early warm-up of the internal combustion engine can be promoted. (2) Even if the LT temperature has not reached the LT determination value, if the HT temperature has reached the HT determination value, the LT cooling control can be started. Herein, the phenomenon in which the HT temperature reaches the HT determination value before the LT temperature reaches the LT determination value occurs when the HT temperature rapidly rises in the warm-up process. While awaiting the LT temperature to reach the LT determination value, a large difference is generated between the LT temperature and the HT temperature before starting the LT cooling control so that large thermal strain tends to occur. In embodiments of the invention, by starting the LT cooling control at a time point when the HT temperature has reached the HT determination value, it is possible to avoid the occurrence of such thermal strain without impeding the requirement for the early warm-up at all.

In the cooling device for an internal combustion engine according to the above-mentioned embodiment, the electronic control unit may be configured to start the LT cooling control also if the LT temperature has reached a LT allowable limit under the condition where the early warm-up is required. The LT allowable limit may be a temperature higher than the LT determination value.

According to this embodiment of the cooling device for an internal combustion engine, under the condition where the early warm-up is required, if the LT temperature has reached the LT allowable limit, the LT cooling control can be started. Therefore, it can be avoided that the LT cooling medium is overheated to exceed the LT allowable limit while waiting for the HT temperature to reach the HT determination value.

In the cooling device for an internal combustion engine according to the above-mentioned embodiment, the electronic control unit may be configured to, if the LT temperature has reached a LT allowable limit before the HT temperature reaches the HT determination value under the condition where the early warm-up is required, implement a LT temperature rise prevention control for maintaining the LT temperature at the LT allowable limit until the HT temperature reaches the HT determination value. The LT allowable limit may be a temperature higher than the LT determination value.

According to this embodiment of the cooling device for an internal combustion engine, under the condition where the early warm-up is required, the LT temperature can be maintained at the LT allowable limit until the HT temperature reaches the HT determination value after the LT temperature has reached the LT allowable limit. That is, after the LT temperature has reached the LT allowable limit, overheating of the LT cooling system can be prevented with the minimum cooling until the LT cooling control is started. Therefore, it is possible to further respond to the requirement for the early warm-up.

In the cooling device for an internal combustion engine according to the above-mentioned embodiment, the specific condition may be a condition where neither a requirement for the early warm-up nor a requirement for knock suppression is arising. The electronic control unit may be configured to, under a condition where the knock suppression is required, start the LT cooling control at an earlier time between the LT temperature reaching the LT determination value and the HT temperature reaching the HT determination value.

According to this embodiment of the cooling device for an internal combustion engine, under the condition where the knock suppression is required, the LT cooling control can be started at the following exemplary timing. (1) Where the LT temperature has reached the LT determination value before the HT temperature reaches the HT determination value.→A time point when the LT temperature has reached the LT determination value. Here, since the start of the LT cooling control is determined based on the LT temperature, it is possible to properly cool the LT cooling medium. As a result, the occurrence of knocking is properly avoided. (2) Where the HT temperature has reached the HT determination value before the LT temperature reaches the LT determination value.→A time point when the HT temperature has reached the HT determination value. According to this process, in the state where the HT temperature is rapidly rising, the start timing of the LT cooling control can be advanced compared to the timing under the specific condition. Since the HT temperature has already reached the HT determination value, even if the start of the LT cooling control is advanced, the warm-up of the body of the internal combustion engine is not delayed. On the other hand, since the cooling start is advanced, even in the state where the temperature of the internal combustion engine is rapidly rising, the temperature of the LT cooling medium is properly maintained low. As a result, the occurrence of knocking is properly avoided without impeding the fuel consumption characteristics of the internal combustion engine.

In the cooling device for an internal combustion engine according to the above-mentioned embodiment, a knock control system configured to retard an ignition crank angle of the internal combustion engine in response to an occurrence of knocking may further be included. The electronic control unit may be configured to, under a condition where the requirement for the early warm-up and the requirement for the knock suppression are both arising, implement the LT cooling control or the LT temperature rise prevention control by giving priority to the requirement for the early warm-up.

According to this embodiment of the cooling device for an internal combustion engine, under the condition where the early warm-up and the knock suppression are both required, the requirement for the early warm-up is given priority so that the LT cooling control is started. Here, even if the LT temperature has reached the LT determination value, unless the HT temperature has reached the HT determination value, the LT cooling control is not started so that an environment in which knocking tends to occur can be formed. In such an environment, the ignition timing is retarded by the knock control system so that the occurrence of knocking is suppressed. If the ignition timing is retarded, the cooling loss of the internal combustion engine increases so that the warm-up is promoted. Therefore, while preventing the occurrence of knocking, the early warm-up of the internal combustion engine can be further promoted.

In the cooling device for an internal combustion engine according to the above-mentioned embodiment, the electronic control unit may be configured to determine the presence or absence of the requirement for the early warm-up prior to a determination about the presence or absence of the requirement for the knock suppression. The electronic control unit may be configured to implement the LT cooling control or the LT temperature rise prevention control if it determines that the requirement for the early warm-up is present.

According to this embodiment of the cooling device for an internal combustion engine, it is possible to give priority to the requirement for the early warm-up over the requirement for the knock suppression without increasing the processing load of the control unit.

In the cooling device for an internal combustion engine according to the above-mentioned embodiment, the LT determination value may belong to a boundary between a temperature region in which knocking occurs and a temperature region in which knocking does not occur, and may be a temperature higher than 0° C.

According to this embodiment of the cooling device for an internal combustion engine, the LT determination value is set in the boundary between the temperature region in which knocking occurs and the temperature region in which knocking does not occur. For example, under the specific condition, the LT cooling control is started when the LT temperature has reached the LT determination value. According to the setting described above, proper suppression of knocking can be ensured under such a condition.

In the cooling device for an internal combustion engine according to the above-mentioned embodiment, the LT determination value may belong to a boundary between a temperature region in which the LT cooling medium freezes and a temperature region in which the LT cooling medium does not freeze, and may be a temperature less than or equal to 0° C.

According to this embodiment of the cooling device for an internal combustion engine, the LT determination value is set in the boundary between the temperature region in which the LT cooling medium freezes and the temperature region in which the LT cooling medium does not freeze. For example, under the specific condition, the LT cooling control is started if the LT temperature has reached the LT determination value. According to the setting described above, under such a condition, it can be avoided that the LT cooling control is started while the LT cooling medium is freezing.

In the cooling device for an internal combustion engine according to the above-mentioned embodiment, the LT cooling system may include a LT temperature sensor that detects the LT temperature and a cooling mechanism that changes a cooling capacity of the LT cooling medium. The LT cooling control may be a feedback control of the cooling mechanism based on an output of the LT temperature sensor. The electronic control unit may be configured to, before starting the LT cooling control, limit a circulation flow rate of the LT cooling medium compared to that during implementation of the feedback control.

According to this embodiment of the cooling device for an internal combustion engine, the LT cooling control can be realized by the feedback control based on the output of the LT temperature sensor. By limiting the circulation flow rate of the LT cooling medium, the cooling capacity of the LT cooling system before starting the LT cooling control can be suppressed.

In the cooling device for an internal combustion engine according to the above-mentioned embodiment, the electronic control unit may be configured to, before starting the LT cooling control, implement the feedback control by applying a guard for limiting the circulation flow rate of the LT cooling medium, to a parameter associated with the circulation flow rate of the LT cooling medium.

According to this embodiment of the cooling device for an internal combustion engine, by guarding the parameter associated with the circulation flow rate of the LT cooling medium, the cooling capacity of the LT cooling system before starting the LT cooling control can be suppressed.

BRIEF DESCRIPTION OF THE DRAWINGS

Features, advantages, and technical and industrial significance of exemplary embodiments of the invention will be described below with reference to the accompanying drawings, in which like numerals denote like elements in the figures, and wherein:

FIG. 2 is a diagram for explaining the basic operation of the configuration shown in FIG. 1;

DETAILED DESCRIPTION OF EMBODIMENTS

Figure 1:
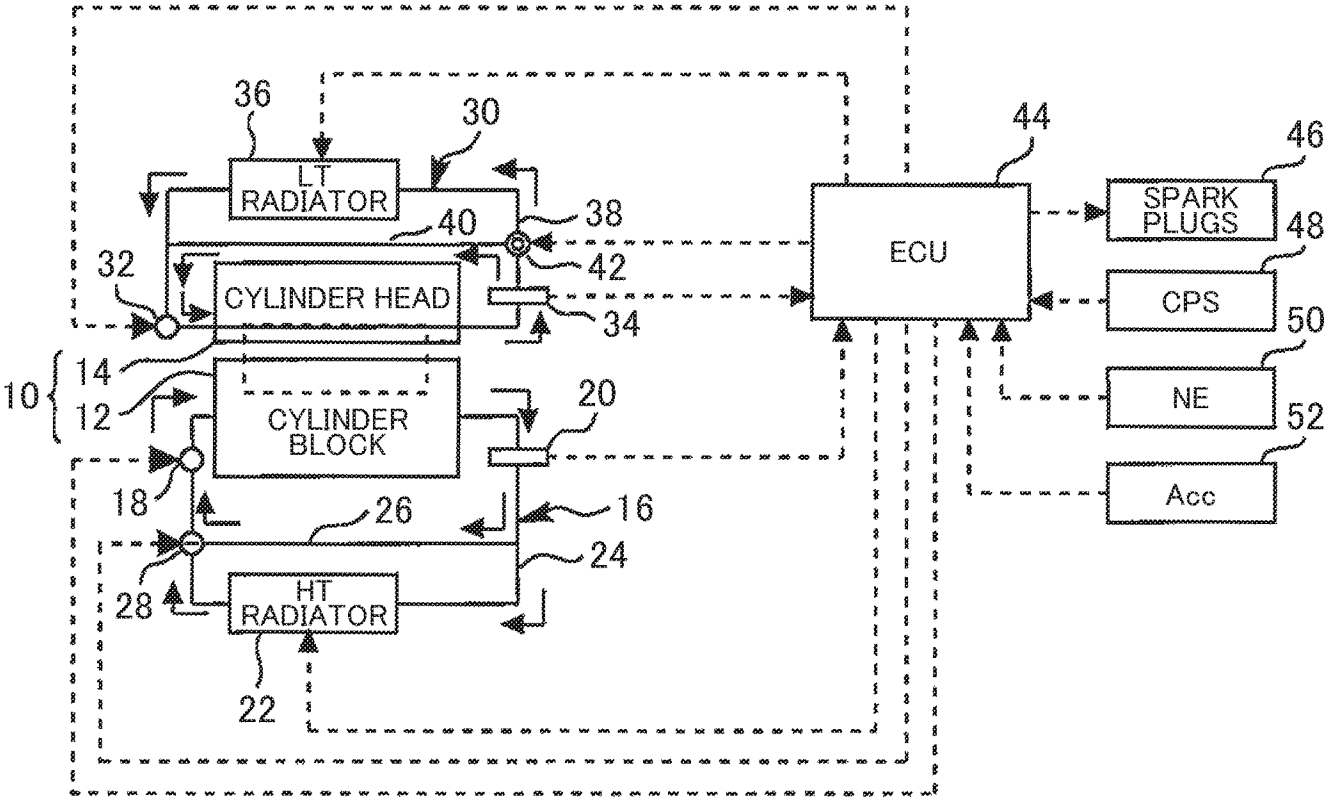
FIG. 1 is a diagram showing a configuration of a first embodiment of the invention.

FIG. 1 is a diagram showing a configuration of a first embodiment of the invention. As shown in FIG. 1, a system of this embodiment includes an internal combustion engine 10. The internal combustion engine 10 is an engine that is used while mounted on a vehicle, and includes a cylinder block 12 and a cylinder head 14. Cooling medium flow passages independent of each other, which will be described hereinbelow, are respectively formed in the cylinder block 12 and the cylinder head 14.

The cooling medium flow passage of the cylinder block 12 constitutes part of a HT (High Temperature) cooling system 16. The HT cooling system 16 is a system for mainly cooling the cylinder block 12 and the exhaust side of the cylinder head 14. The HT cooling system 16 includes an electric water pump (E-W/P) 18 on the inlet side of the cylinder block 12. The E-W/P 18 can discharge cooling water toward the cylinder block 12 with a discharge capacity corresponding to a drive signal supplied from the outside. Hereinafter, the cooling water that flows in the HT cooling system 16 will be referred to as a "HT cooling medium".

A HT temperature sensor 20 is provided on the outlet side of the cylinder block 12. The HT temperature sensor 20 produces a signal (ethwH) corresponding to a temperature of the HT cooling medium (hereinafter referred to as a "HT temperature").

The HT cooling system 16 includes a circulation passage 24 provided with a HT radiator 22 and a bypass passage 26 bypassing the HT radiator 22. The HT radiator 22 can cool the HT cooling medium flowing therein by the vehicle traveling wind. The HT radiator 22 is provided with a cooling fan (not shown) and, as needed, can cool the HT cooling medium also by the air introduced by the cooling fan.

The bypass passage 26 has one end connected to the circulation passage 24 via a three-way valve 28. In response to an opening degree signal supplied from the outside, the three-way valve 28 can switch between a state for circulating the HT cooling medium through the bypass passage 26 (hereinafter referred to as a "bypass state") and a state for circulating the HT cooling medium through the HT radiator 22 (hereinafter referred to as a "radiator state").

On the other hand, the cooling medium flow passage of the cylinder head 14 constitutes part of a LT (Low Temperature) cooling system 30. Compared to the HT cooling system 16, the LT cooling system 30 is a cooling system for mainly cooling the peripheries of intake ports. The LT cooling system 30 includes an electric water pump (E-W/P) 32 on the inlet side of the cylinder head 14. The E-W/P 32 can discharge cooling water toward the cylinder head 14 with a discharge capacity corresponding to a drive signal supplied from the outside. Hereinafter, the cooling water that flows in the LT cooling system 30 will be referred to as a "LT cooling medium".

A LT temperature sensor 34 is provided on the outlet side of the cylinder head 14. The LT temperature sensor 34 produces a signal (ethwL) corresponding to a temperature of the LT cooling medium (hereinafter referred to as a "LT temperature").

The LT cooling system 30 includes a circulation passage 38 provided with a LT radiator 36 and a bypass passage 40 bypassing the LT radiator 36. Like the HT radiator 22, the LT radiator 36 can cool the LT cooling medium by the vehicle traveling wind or by the cooling air produced by a built-in cooling fan (not shown).

The bypass passage 40 has one end connected to the circulation passage 38 via a three-way valve 42. Like the three-way valve 28 on the HT side, in response to a signal from the outside, the three-way valve 42 can switch between a bypass state for circulating the LT cooling medium through the bypass passage 40 and a radiator state for circulating the LT cooling medium through the LT radiator 36.

The system shown in FIG. 1 includes an electronic control unit (ECU) 44. The ECU 44 can detect a HT temperature and a LT temperature based on the sensor signals ethwH and ethwL described above. Further, the ECU 44 can control the states of the cooling fan of the HT radiator 22 and the cooling fan of the LT radiator 36. In addition, the ECU 44 can control the states of the two E-W/Ps 18 and 32 and the two three-way valves 28 and 42.

Various sensors and actuators mounted on the internal combustion engine 10 are electrically connected to the ECU 44. For example, the ECU 44 can command an ignition timing for each of spark plugs 46 attached to respective cylinders of the internal combustion engine 10. Further, the ECU 44 can detect an in-cylinder pressure of each cylinder based on an output of an in-cylinder pressure sensor (CPS) 48 disposed per cylinder. In addition, the ECU 44 can detect an engine rotational speed (NE) based on an output of an NE sensor 50 and can detect an accelerator opening degree (Acc) based on an output of an accelerator opening degree sensor 52.

The system of this embodiment is equipped with a knock control system (KCS). In the internal combustion engine 10, as the ignition crank angle is more advanced, the occurrence of knocking becomes more likely. On the other hand, in the internal combustion engine 10, as the ignition crank angle is more advanced, better fuel consumption characteristics can be obtained. Therefore, it is desirable that the ignition crank angle of an internal combustion engine be advanced as long as knocking does not occur.

The KCS is a system for satisfying the requirement described above and is specifically configured to perform the following processes. (1) To detect an occurrence of knocking per cylinder based on an output of the CPS 48. (2) To retard the ignition crank angle in a stepped manner in the cylinder in which knocking is occurring. (3) To gradually advance the ignition crank angle in the cylinder in which the occurrence of knocking is not detected. In the internal combustion engine 10 of this embodiment, by the function of the KCS, it is possible to properly suppress the occurrence of knocking while ensuring good fuel consumption characteristics.

As described above, the internal combustion engine 10 includes the HT cooling system 16. The HT cooling system 16 can realize the following several states. (S1) E-W/P 18 is stopped, Three-Way Valve 28 is in Bypass State, and Fan of HT Radiator 22 is stopped, (S2) E-W/P 18 is driven, Three-Way Valve 28 is in Bypass State, and Fan of HT Radiator 22 is stopped, (S3) E-W/P 18 is driven, Three-Way Valve 28 is in Radiator State, and Fan of HT Radiator 22 is stopped, and (S4) E-W/P 18 is driven, Three-Way Valve 28 is in Radiator State, and Fan of HT Radiator 22 is driven.

The HT cooling system 16 exhibits the minimum cooling capacity in a state (S1) described above and increases the cooling capacity as the state changes, e.g., (S2)→(S3)→(S4). In this embodiment, the HT cooling system 16 is maintained in the state (S1) until a HT cooling start condition is established after the internal combustion engine 10 is started. After the HT cooling start condition is established, the HT cooling system 16 is suitably controlled to states (S2) to (S4) in order to maintain the HT temperature at a HT target temperature (e.g. 75° C.). Hereinafter, the control for maintaining the HT target temperature will be referred to as a "HT cooling control".

Like the HT cooling system 16, the LT cooling system 30 can also change the cooling capacity by switching between the following states. (s1) E-W/P 32 is stopped, Three-Way Valve 42 is in Bypass State, and Fan of LT Radiator 36 is stopped, (s2) E-W/P 32 is driven, Three-Way Valve 42 is in Bypass State, and Fan of LT Radiator 36 is stopped, (s3) E-W/P 32 is driven, Three-Way Valve 42 is in Radiator State, and Fan of LT Radiator 36 is stopped, and (s4) E-W/P 32 is driven, Three-Way Valve 42 is in Radiator State, and Fan of LT Radiator 36 is driven.

The LT cooling system 30 is maintained in a state (s1) until a LT cooling start condition is established after the start of the internal combustion engine 10. After the LT cooling start condition is established, the LT cooling system 30 is suitably controlled to the states (s2) to (s4) in order to maintain the LT temperature at a LT target temperature (e.g. 45° C.). Hereinafter, the control for maintaining the LT target temperature will be referred to as a "LT cooling control".

FIG. 2 is a diagram showing LT cooling start conditions and a HT cooling start condition used in this embodiment, in comparison with those of a comparative example. In FIG. 2, the column of "Comparative Example" means that the LT cooling start condition is the establishment of "LT Temperature LT Determination Value" and that the HT cooling start condition is the establishment of "HT Temperature≥HT Determination Value". The indication of "Independently" means that the LT cooling start condition is determined "independently" of a state of the HT cooling system 16 and that the HT cooling start condition is determined "independently" of a state of the LT cooling system 30.

As described above, the LT cooling start condition is the condition for starting the LT cooling control to maintain the LT temperature at the LT target temperature. Herein, the LT target temperature is a temperature for forming a temperature environment that prevents the occurrence of knocking, around the intake ports. In this embodiment, and also in the comparative example, it is assumed that the LT target temperature is 45° C. In the warm-up process of the internal combustion engine 10, the LT temperature is expected to rise to some extent even after the LT cooling control is started. Therefore, the LT determination value should be set to a temperature lower than the LT target temperature. In this embodiment, and also in the comparative example, it is assumed that the LT determination value is 30° C. However, the LT target temperature and the LT determination value are not limited to these temperatures. The LT determination value is satisfactory if it is a temperature belonging to the boundary between a temperature region that prevents the occurrence of knocking and a temperature region in which there is a possibility of the occurrence of knocking.

The HT cooling start condition is the condition for starting the HT cooling control to maintain the HT temperature at the HT target temperature. Herein, the HT target temperature is a temperature for forming a temperature environment that can sufficiently suppress the mechanical friction of the internal combustion engine 10 and that does not cause the excessive cooling loss of the internal combustion engine 10. In this embodiment, and also in the comparative example, it is assumed that the HT target temperature is 75° C. In the warm-up process of the internal combustion engine 10, the HT temperature is expected to rise to some extent even after the HT cooling control is started. Therefore, the HT determination value should be set to a temperature lower than the HT target temperature. In this embodiment, and also in the comparative example, it is assumed that the HT determination value is 60° C. However, the HT target temperature and the HT determination value are not limited to these temperatures.

According to the comparative example, the HT cooling system 16 and the LT cooling system 30 determine the establishment of the cooling start conditions independently of each other in the warm-up process of the internal combustion engine 10. In this example, the temperature of the cylinder block 12 and the temperature of the peripheries of the intake ports properly converge to about the target temperatures (75° C., 45° C.), respectively.

In the internal combustion engine 10, sometimes a requirement arises to complete the warm-up early, for example, immediately after the start-up at a cold time. As the LT cooling control is started to cool the cylinder head 14, the heat is naturally transmitted from the cylinder block 12 to the cylinder head 14. Therefore, in order to respond to the requirement for early warm-up, even if the LT temperature has reached the LT determination value, it is desirable not to start the LT cooling control until the warm-up of the cylinder block 12 progresses sufficiently thereafter.

In the internal combustion engine 10, there are examples where the HT temperature rapidly rises prior to the LT temperature, for example, when the high-load operation is performed immediately after the start-up. In this example, if the LT cooling control is started after waiting for the LT temperature to reach the LT determination value, sometimes the peripheries of the intake ports are temporarily in an overheated state so that an environment where knocking tends to occur is formed. Therefore, where the HT temperature rapidly rises and the internal combustion engine 10 is operating in a region that tends to cause the occurrence of knocking, it is desirable to start the LT cooling control before the LT temperature reaches the LT determination value.

According to the comparative example described above, even if the HT temperature is low, if the LT temperature has reached the LT determination value, the LT cooling control is started at that time point. Therefore, in this comparative example, a situation can occur in which, when the requirement for early warm-up is arising, the progress of the warm-up is impeded due to the start of the LT cooling control. Further, in the comparative example, even if the HT temperature rapidly rises to exceed the HT determination value, unless the LT temperature has reached the LT determination value, the LT cooling control is not started. Therefore, in this comparative example, where the high-load operation of the internal combustion engine 10 is performed after the start-up, sometimes the peripheries of the intake ports temporarily rise to a high temperature to allow the formation of a temperature environment that tends to cause the occurrence of knocking.

In FIG. 2, the conditions shown in the column of "First Embodiment" represent the LT cooling start conditions and the HT cooling start condition that are used in this embodiment. As shown herein, also in this embodiment, as in the comparative example, "HT Temperature≥HT Determination Value" is always used as the HT cooling start condition. On the other hand, for the LT cooling start conditions, "LT Temperature≥LT Determination Value" or "HT Temperature≥HT Determination Value" is used according to a state of the internal combustion engine 10. According to these LT cooling start conditions, it is possible to avoid the above-mentioned disadvantages that occur in the case of the comparative example.

As shown in FIG. 2, the LT cooling start conditions in the column of "First Embodiment" are determined so as to be classified for an example of "HT Has Reached A Determination Value Earlier" (hereinafter referred to as "HT precedent") and an example of "LT Has Reached A Determination Value Earlier" (hereinafter referred to as "LT precedent"). Further, the LT cooling start conditions in the column of "First Embodiment" are determined so as to be classified for the following four states. •An example where only "Early Warm-Up Requirement" is arising, •an example where only "Knock Suppression Requirement" is arising, •an example where neither requirement is arising, and •an example where the requirement for early warm-up and the requirement for knock suppression interfere with each other (both are arising).

Specifically, where only "Early Warm-Up Requirement" is arising, "HT Temperature≥HT Determination Value" is used as the LT cooling start condition both with respect to HT precedent and LT precedent. Since, according to this condition, the cooling start of LT is made to cooperate with the state of the HT side, an explanation of "Cooperation" is given thereto.

Herein, with respect to HT precedent, if "HT Temperature≥HT Determination Value" is the start condition, the start time of the LT cooling control is advanced compared to with LT independent determination, i.e. where the LT cooling control is started by the establishment of "LT Temperature≥LT Determination Value". Therefore, an explanation of "Advanced" is given to the side of HT precedent along with the explanation of "Cooperation". The HT-precedent warm-up occurs, for example, if the high-load operation of the internal combustion engine 10 is performed after the start-up so that the HT temperature rapidly rises. Here, if the LT cooling control is started after waiting for the LT temperature to reach the LT determination value, the difference between the LT temperature and the HT temperature becomes large before starting the LT cooling control and, following the start of the LT cooling control, large thermal strain tends to occur. In this embodiment, since the start time of the LT cooling control can be advanced with respect to HT precedent, it is possible to avoid the occurrence of such thermal strain.

On the other hand, with respect to LT precedent, if "HT Temperature≥HT Determination Value" is the start condition, the start time of the LT cooling control is delayed compared to with LT independent determination. Therefore, an explanation of "Delayed" is given to the side of LT precedent along with the explanation of "Cooperation". With respect to LT precedent, if the LT temperature has reached the LT determination value, the HT temperature has not yet reached the HT determination value. That is, at the stage where the LT temperature has reached the LT determination value, the warm-up of the cylinder block 12 has not yet progressed sufficiently. If the LT cooling control is started at this stage, the amount of heat transmitted from the cylinder block 12 to the cylinder head 14 increases so that the warm-up of the internal combustion engine 10 is impeded. In this embodiment, since the start of the LT cooling control can be delayed until the HT temperature reaches the HT determination value, it is possible to properly respond to the requirement for early warm-up of the internal combustion engine 10.

The ECU 44 of this embodiment recognizes "Knock Suppression Requirement", for example, in a high load region where knocking tends to occur. In this embodiment, under the condition where only "Knock Suppression Requirement" arises, the LT cooling start condition is switched according to whether it is HT precedent or LT precedent. Specifically, with respect to HT precedent, "HT Temperature≥HT Determination Value" is used as the LT cooling start condition. As described above, in the environment where HT precedent occurs, large thermal strain tends to occur following the start of the LT cooling control. According to this embodiment, also herein, the start time of the LT cooling control can be "Advanced" by "Cooperation" so that such thermal strain can be moderated. In the state where HT precedent occurs, if the LT cooling control is started after waiting for the LT temperature to reach the LT determination value, the peripheries of the intake ports are temporarily in an overheated state, resulting in a state that tends to induce knocking and that tends to deteriorate the charging efficiency of air. In contrast, if the LT cooling control is started at the stage where the HT temperature has reached the HT determination value, a period of time during which the peripheries of the intake ports can be maintained at a low temperature can be extended to prevent overheating thereof so that knocking can be properly suppressed and that the fuel consumption characteristics of the internal combustion engine can be improved.

If the LT-precedent warm-up is performed under the condition where the knock suppression requirement arises, the LT independent determination is carried out using "LT Temperature≥LT Determination Value" as the start condition. Here, if "HT Temperature≥HT Determination Value" is the start condition of the LT cooling control, even after the LT temperature has reached the LT determination value, the start of the LT cooling control is postponed until the HT temperature reaches the HT determination value. The peripheries of the intake ports rise to a high temperature before starting the LT cooling control so that a situation can occur that cannot respond to the requirement for knock suppression. According to this embodiment, it is possible to start the LT cooling control at a proper timing so that the LT temperature can be correctly controlled in a temperature region that does not cause the occurrence of knocking.

Where neither the early warm-up requirement nor the knock suppression requirement is arising, it is desirable to start the LT cooling control at a timing optimum for the LT side without cooperation with the HT side. Therefore, the LT independent determination is carried out regardless of HT precedent or LT precedent. As a result, it is possible to create a temperature environment suitable for the internal combustion engine 10.

In the state where both the early warm-up and the knock suppression of the internal combustion engine 10 are required, the early warm-up requirement is given priority. That is, "HT Temperature≥HT Determination Value" is always used as the LT cooling start condition. According to this condition, in the state of HT precedent, the start time of the LT cooling control is advanced compared to where "LT Temperature≥LT Determination Value" is used as the start condition. In this event, since the HT temperature has already risen to the HT determination value, the start of the LT cooling control is not against the early warm-up requirement. Further, since the start time is advanced, a period of time during which the LT temperature can be maintained low is prolonged so that it is also possible to respond to the requirement for knock suppression.

In the state of LT precedent, if "HT Temperature≥HT Determination Value" is used as the start condition, the start time of the LT cooling control is delayed compared to with LT independent determination. That is, even after the LT temperature has reached the LT determination value, the start of the LT cooling control is postponed until the HT temperature reaches the HT determination value. The HT temperature can rise to the HT determination value without being impeded by the LT cooling control. Therefore, according to this condition, it is possible to properly respond to the early warm-up requirement. On the other hand, since the start of the LT cooling control is delayed, the temperature of the peripheries of the intake ports tends to rise to a high temperature compared to with LT independent determination. As a result, according to this condition, although temporarily, a situation can occur in which a temperature environment that tends to cause the occurrence of knocking is formed around the intake ports. Herein, as described above, the system of this embodiment is equipped with the KCS. Therefore, if knocking occurs in the internal combustion engine 10, the ignition timing is retarded so as to eliminate the knocking. If the ignition timing is retarded, the occurrence of knocking is suppressed and simultaneously the cooling loss of the internal combustion engine 10 increases. As a result, the heat receiving amount of the cylinder block 12 increases so that the warm-up of the internal combustion engine 10 is further promoted. According to this embodiment, even with respect to LT precedent, it is possible to properly respond to both the early warm-up requirement and the knock suppression requirement.

Figure 3A:
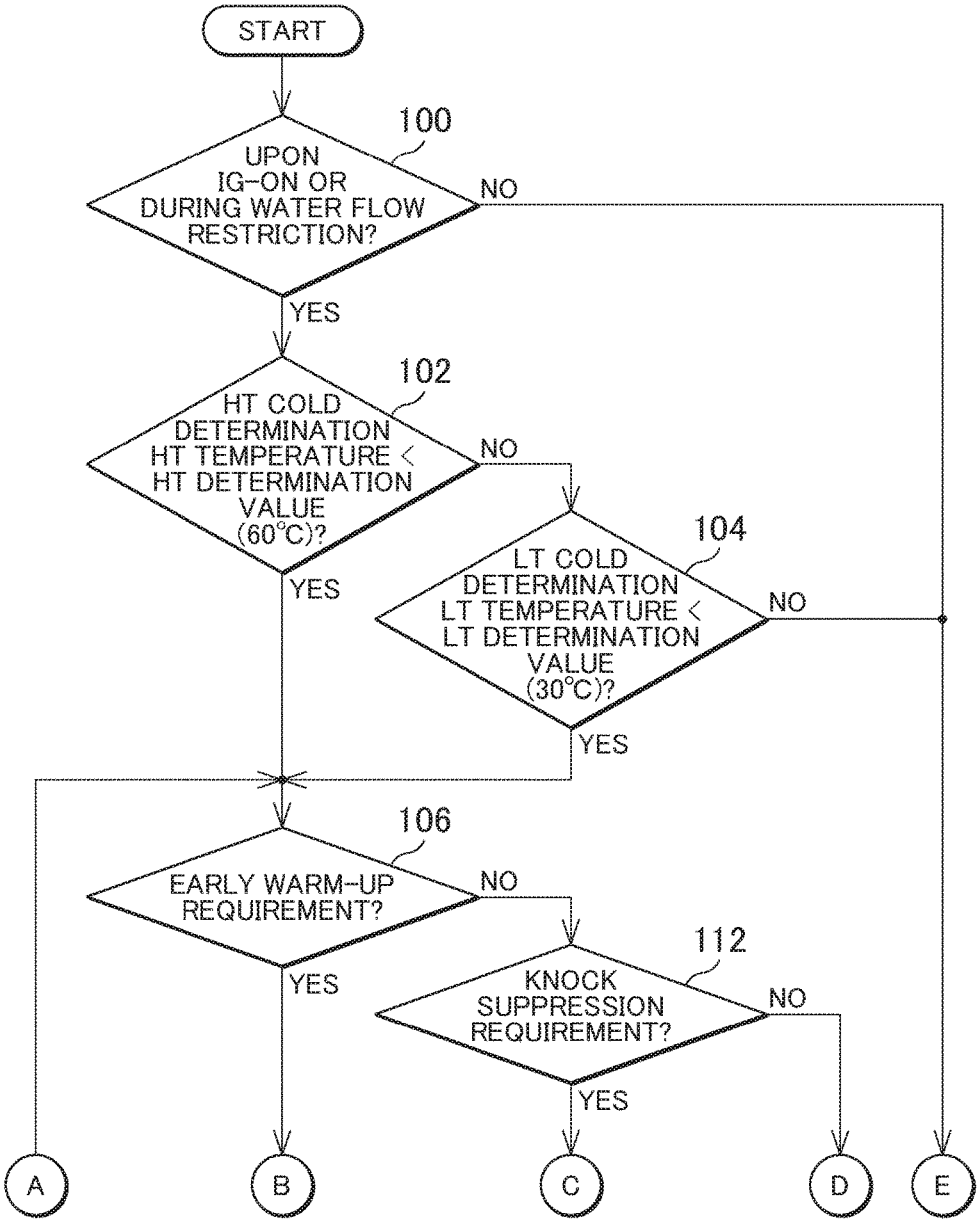
FIG. 3A and FIG. 3B are flowcharts of a routine implemented in the first embodiment of the invention.
Figure 3B:
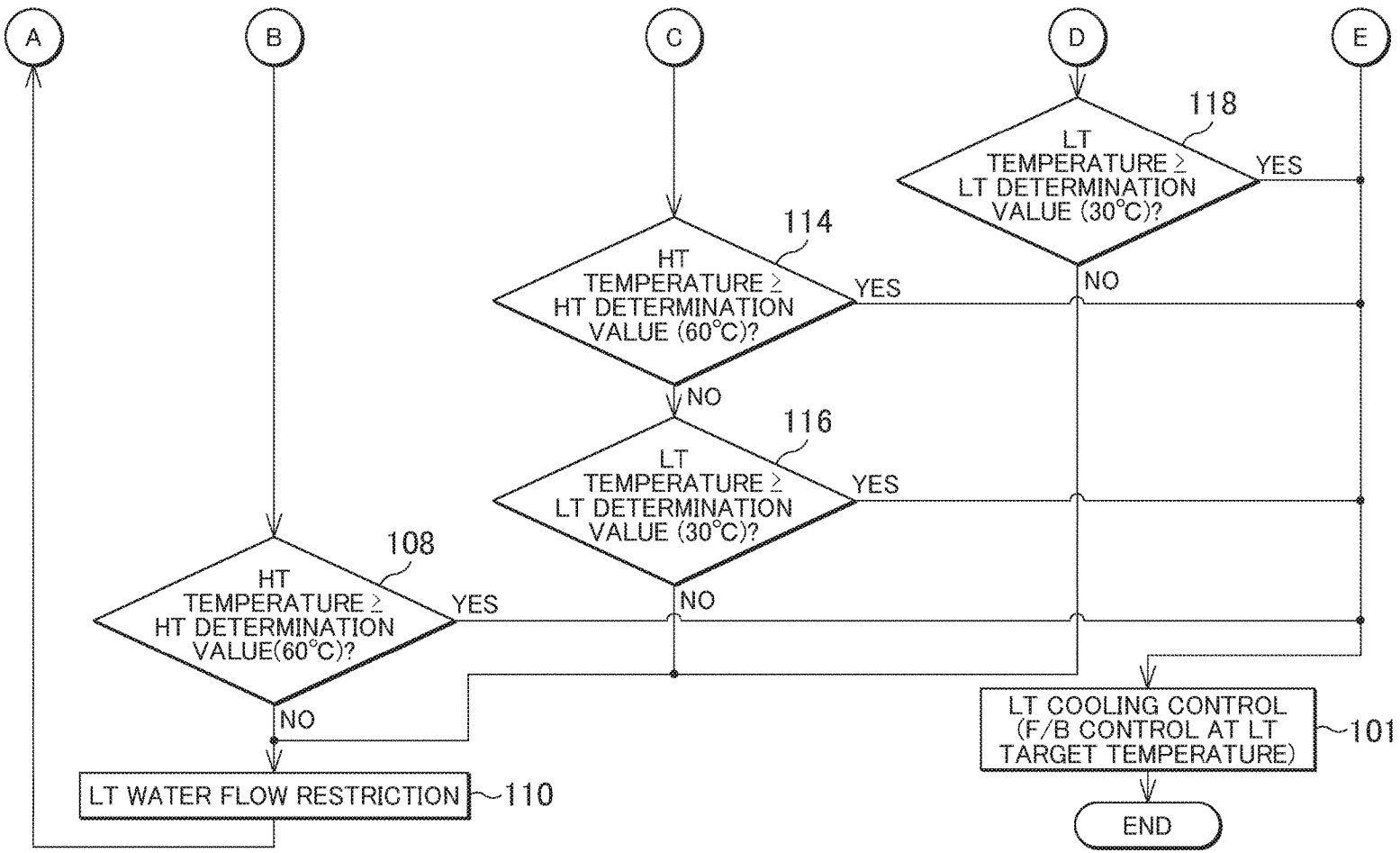

FIG. 3A and FIG. 3B are flowcharts of a routine implemented by the ECU 44 for starting the LT cooling control according to the rule described above. In the routine shown in FIG. 3A and FIG. 3B, first, it is determined whether the current routine is started immediately after ignition (IG) ON or during water flow restriction (step 100). If the ECU 44 imposes a water flow restriction on the LT cooling system 30, the ECU 44 sets a flag indicative of during water flow restriction. Herein, the determination described above is carried out based on that flag.

If neither immediately after IG-ON nor during water flow restriction, it can be determined that both the HT cooling control and the LT cooling control have already been started normally. In this example, the LT cooling control, i.e. a feedback control for maintaining the LT temperature at the LT target temperature (45° C. in this embodiment), is implemented promptly thereafter (step 101). If the process of step 101 is implemented, the water flow restriction flag described above is cleared.

On the other hand, if the establishment of the condition at step 100 is confirmed, then a cold determination for the HT cooling system 16 is carried out (step 102). Specifically, herein, it is determined whether or not a HT temperature detected by the HT temperature sensor 20 is lower than the HT determination value (60° C. in this embodiment).

If the condition at step 102 is denied, it can be determined that the HT cooling system 16 has already passed through the cold state. As such, a cold determination for the LT cooling system 30 is carried out (step 104). Herein, it is determined whether or not a LT temperature detected by the LT temperature sensor 34 is lower than the LT determination value (30° C. in this embodiment).

If the condition at step 104 is denied, it can be determined that the LT cooling system 30 has also already passed through the cold state in addition to the HT cooling system 16. If so, since it can be determined that both the HT cooling control and the LT cooling control have already been started normally, the process of step 101 is implemented promptly thereafter.

If the condition at step 102 or the condition at step 104 is established, it can be determined that at least one of the HT cooling system 16 and the LT cooling system 30 is in the cold state. As such, subsequent processes are started in order to determine the start of the LT cooling control.

Herein, first, it is determined whether or not the requirement for early warm-up is arising in the internal combustion engine 10 (step 106). In this embodiment, it is determined that the early warm-up requirement is arising if the following requirement is arising. (1) Use of a heater in a cabin is required (in this embodiment, specifically, use of a heater is required at an outside air temperature less than or equal to a predetermined temperature (e.g. 0° C.)). (2) Early warm-up of a catalyst is required for exhaust gas purification. (3) EGR introduction is required (early warm-up is required for stable combustion).

If the requirement for early warm-up is confirmed at step 106, it is determined whether or not "HT Temperature HT Determination Value" is established as the LT cooling start condition (step 108). As a result, if the establishment of this condition is confirmed, the process of step 101 is implemented promptly thereafter to start the LT cooling control. According to this condition, the LT cooling control is always started after the HT temperature has reached the HT determination value regardless of HT precedent or LT precedent and, therefore, the requirement for early warm-up is not impeded by that effect.

On the other hand, if the determination at step 108 is negative, it can be determined that the LT cooling start condition is not established. In this embodiment, the water flow restriction of the LT cooling system 30 is continued (step 110). Specifically, herein, the E-W/P 32 is maintained in a stop state in order to stop the circulation of the LT cooling medium. While the process of step 110 is implemented, the water flow restriction flag described above is on. After the completion of this process, the process of step 106 is implemented again.

In the routine shown in FIG. 3A and FIG. 3B, if it is determined at step 106 that the requirement for early warm-up is not arising, then it is determined whether or not the requirement for knock suppression is arising (step 112). Knocking of the internal combustion engine 10 occurs in a specific operating region (hereinafter referred to as a "knock occurrence region"). The ECU 44 is storing information about the knock occurrence region and determines that the requirement for knock suppression is arising when a combination of a current engine rotational speed Ne and a current engine load KL belongs to the knock occurrence region.

If it is determined that the requirement for knock suppression is arising, then it is determined whether or not "HT Temperature≥HT Determination Value" is established as a first start condition (step 114). If the HT temperature has already reached the HT determination value, even if the LT temperature has not yet reached the LT determination value, the LT cooling control should be started in terms of suppressing knocking (see the case of HT precedent in FIG. 2). Therefore, if it is determined that this condition is established, the process of step 101 is implemented promptly thereafter.

If it is determined at step 114 that the HT temperature has not yet reached the HT determination value, then it is determined whether or not "LT Temperature≥LT Determination Value" is established as a second start condition (step 116). Even if the HT temperature has not yet reached the HT determination value, in the state where the suppression of knocking is required, it is desirable to start the LT cooling control at the stage where the LT temperature has reached the LT determination value (see the example of LT precedent in FIG. 2). Therefore, also where the establishment of this condition is confirmed, the process of step 101 is implemented promptly thereafter. According to the processes described above, the LT cooling control can always be started at a timing suitable for knock suppression regardless of HT precedent or LT precedent.

On the other hand, if the condition at step 116 is not established, it can be determined that the HT side and the LT side have not yet been warmed up to their respective determination values. Even in the state where the suppression of knocking is required, there is no need to start the LT cooling control at this stage yet. Therefore, the process of step 110 is implemented to maintain the water flow restriction of LT.

If it is determined at step 112 that the requirement for knock suppression is not arising, it can be determined that neither the early warm-up nor the knock suppression is required for the internal combustion engine 10. Here, in order to carry out the LT independent determination, it is determined whether or not "LT Temperature LT Determination Value" is established (step 118). As a result, if the establishment of this condition is confirmed, the LT cooling control is started at step 101. On the other hand, if this condition is denied, the process of step 110 is implemented to maintain the water flow restriction.

In the routine shown in FIG. 3A and FIG. 3B, step 106 that determines the presence or absence of the early warm-up requirement is implemented prior to step 112 that determines the presence or absence of the knock suppression requirement. Therefore, under the condition where those two requirements interfere with each other, the requirement for early warm-up is always preferentially confirmed so that the LT cooling control can be started under the same condition as in the case of the presence of the early warm-up requirement (see the row of "Interference of Requirements" in FIG. 2).

Figure 4:
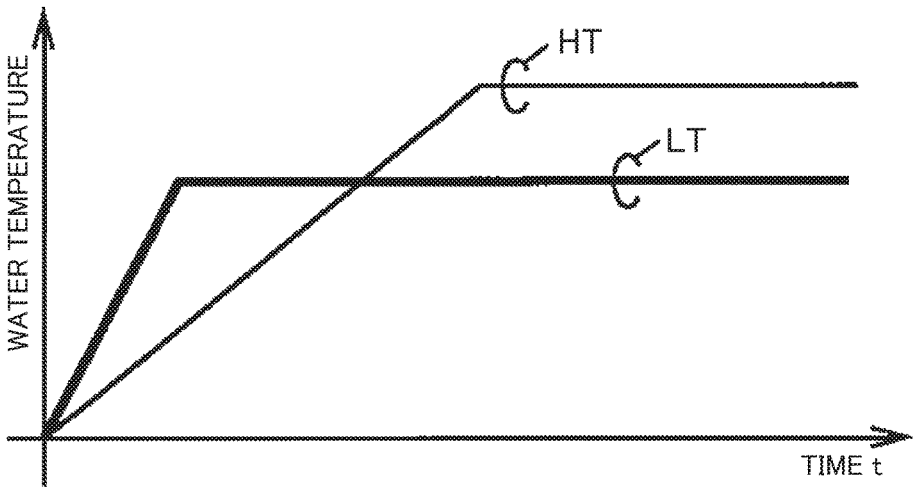
FIG. 4 is a diagram showing a state in which a LT temperature rises prior to a HT temperature in the warm-up process of an internal combustion engine.

FIG. 4 schematically shows typical changes of the LT temperature (thick line) and the HT temperature (thin line) where the warm-up progresses under LT precedent. Hereinbelow, referring to FIGS. 5 and 6, the feature of this embodiment in this state will be described again.

Figure 5:
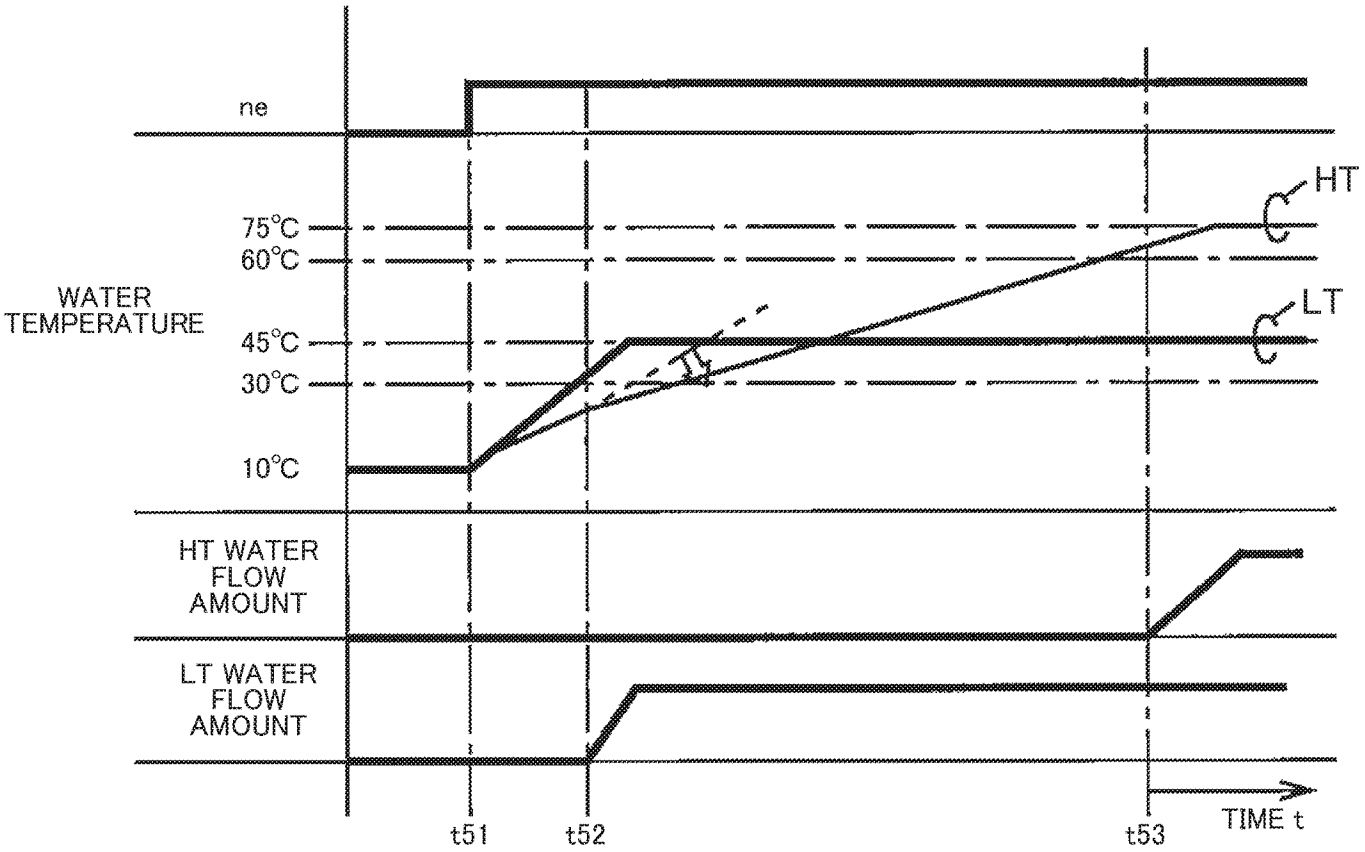
FIG. 5 is a timing chart for explaining one example of an operation realized by a cooling device of a comparative example under a condition where early warm-up is required.

FIG. 5 shows an operation example of the comparative example (see FIG. 2) under LT precedent. In this example, after the internal combustion engine 10 is started at time t51, the LT temperature (thick line) and the HT temperature (thin line) rise under LT precedent. In the cooling device of the comparative example, "LT Temperature≥LT Determination Value" is always used as the LT cooling start condition. Therefore, if the LT temperature has reached the LT determination value (30° C.) at time t52, the LT cooling control is started at that time point (see the column of "LT Water Flow Amount"). As a result, after time t52, the rise rate of the HT temperature decreases so that the warm-up of the internal combustion engine 10 is impeded. In the example shown in FIG. 5, the completion of the warm-up is determined at time t53 at which the HT temperature has reached the HT determination value (60° C.), so that the HT cooling control is started.

Figure 6:
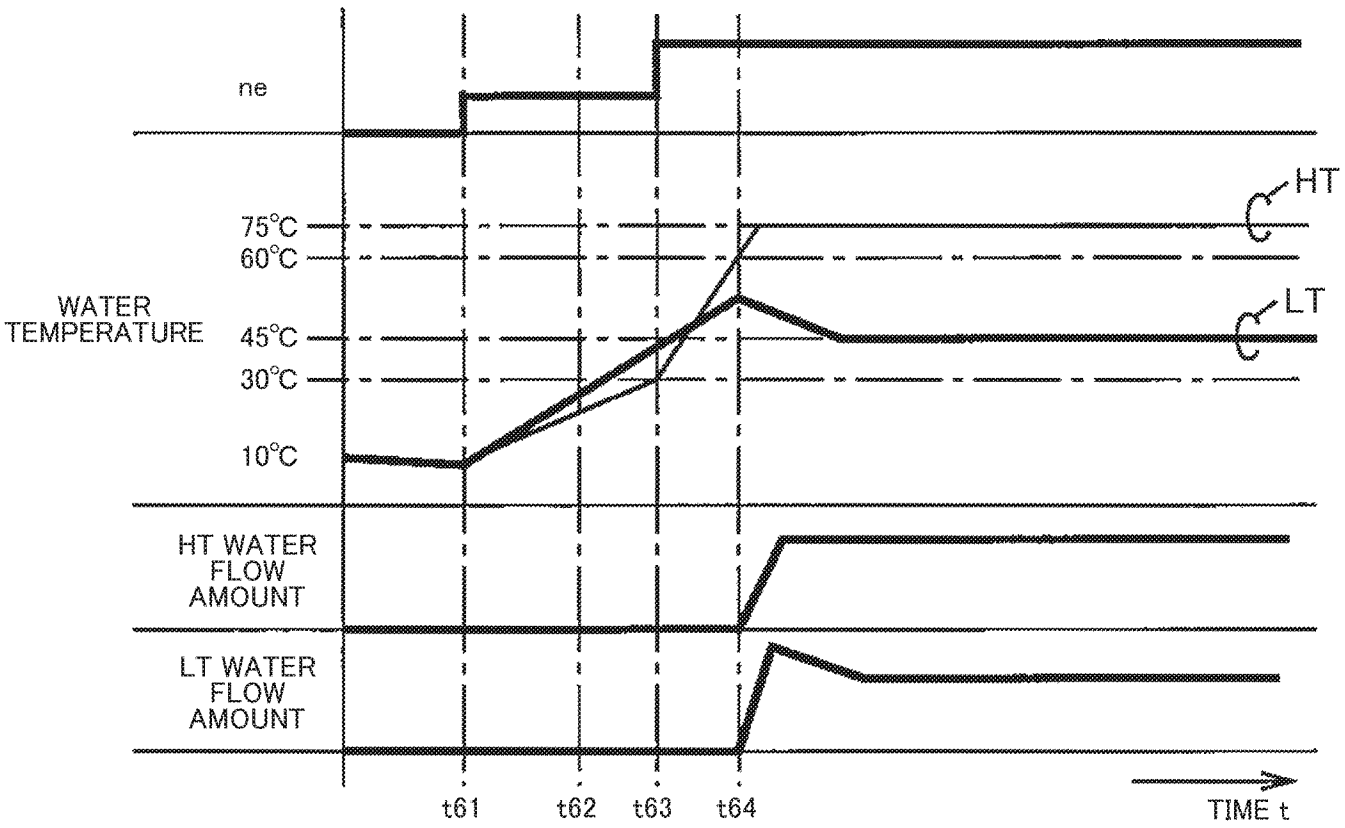
FIG. 6 is a timing chart for explaining one example of an operation realized by the first embodiment of the invention under a condition where early warm-up is required.

FIG. 6 shows an operation example of this embodiment. The operation shown in FIG. 6 occurs when the warm-up progresses under LT precedent under the requirement for early warm-up. In the cooling device of this embodiment, if the requirement for early warm-up is arising, "HT Temperature≥HT Determination Value" is used as the LT cooling start condition. In the example shown in FIG. 6, the LT temperature has reached the LT determination value (30° C.) at time t62, but, in this embodiment, the LT cooling control is not started at that time point. Therefore, even after time t62, the HT temperature continues to rise without decreasing the change rate. Thereafter, if the HT temperature has reached the HT determination value at time t64, it is determined that the warm-up of the internal combustion engine 10 is completed, so that the LT cooling control is started simultaneously with the HT cooling control. According to the operation described above, the HT temperature can rise to the HT determination value without being impeded by the LT cooling control. Therefore, according to the cooling device of this embodiment, it is possible to properly respond to the requirement for early warm-up. In FIG. 6, for convenience' sake, there is shown a state in which the rise rate of the HT temperature increases following the acceleration after time t63.

Figure 7:
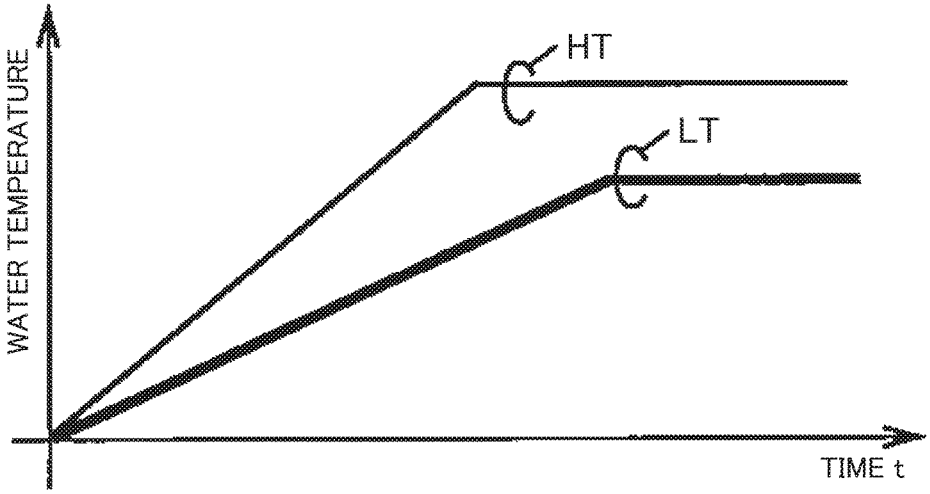
FIG. 7 is a diagram showing a state in which a HT temperature rises prior to a LT temperature in the warm-up process of an internal combustion engine.

FIG. 7 schematically shows typical changes of the LT temperature (thick line) and the HT temperature (thin line) where the warm-up progresses under HT precedent. Hereinbelow, referring to FIGS. 8 and 9, the feature of this embodiment in this state will be described again.

Figure 8:
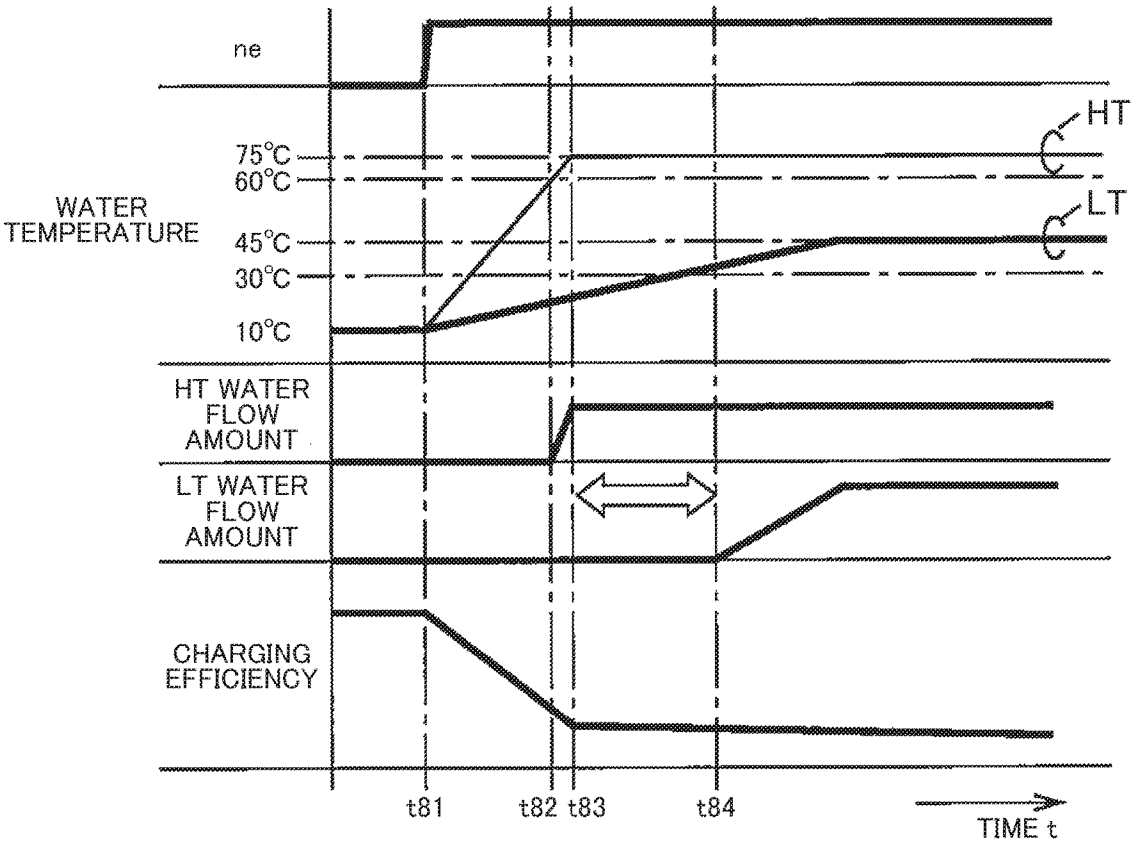
FIG. 8 is a timing chart for explaining one example of an operation realized by a cooling device of a comparative example under a condition where knock suppression is required.

FIG. 8 shows an operation example of the comparative example (see FIG. 2) under HT precedent. In this example, after the start of the internal combustion engine 10 (time t81), the LT temperature (thick line) and the HT temperature (thin line) rise under HT precedent. In the cooling device of the comparative example, "LT Temperature≥LT Determination Value" is always used as the LT cooling start condition. Therefore, according to this device, even after the HT temperature has reached the HT determination value (60° C.) at time t82 and further has reached the HT target temperature (75° C.) at time t83, the LT cooling control is not started until time t84 at which the LT temperature reaches the LT determination value.

Figure 9:
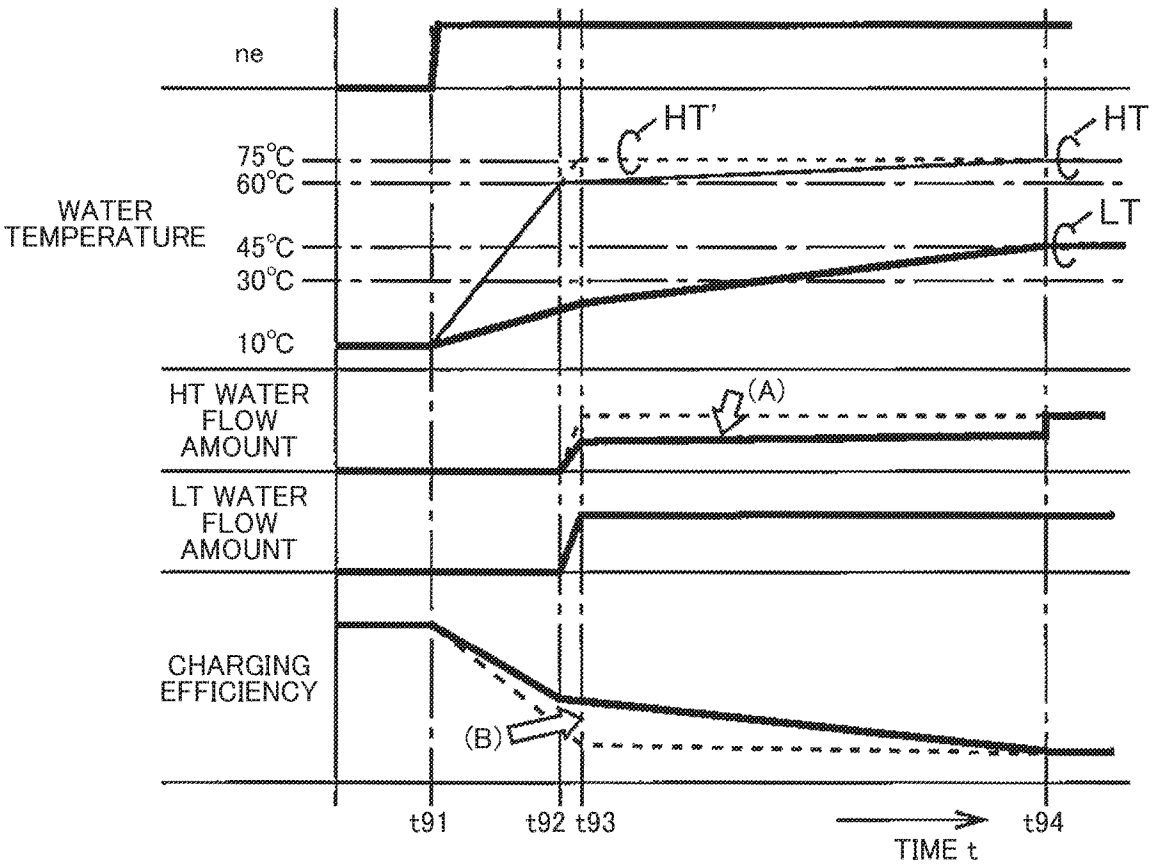
FIG. 9 is a timing chart for explaining one example of an operation realized by the first embodiment of the invention under a condition where knock suppression is required.

FIG. 9 shows an operation example of this embodiment. The operation shown in FIG. 9 occurs if the warm-up progresses under HT precedent in the state where knock suppression is required. In the cooling device of this embodiment, under this condition, "HT Temperature≥HT Determination Value" is used as the LT cooling start condition. In the example shown in FIG. 9, after the internal combustion engine 10 is started (time t91), the HT temperature has reached the HT determination value (60° C.) at time t92 and, at that time point, the HT cooling control and the LT cooling control are started simultaneously.

In FIG. 9, a broken line of "HT" shown in the column of "Water Temperature" shows the change of the HT temperature assuming that the LT cooling control is not started at time t92. According to this change, the HT' temperature reaches the HT target temperature (75° C.) at time t93. The HT temperature in this embodiment rises gently compared the change shown by HT' due to the influence of the LT cooling control and reaches the HT target temperature at time t94. Further, in this embodiment, after time t92, the LT temperature also rises gently compared to the case of the comparative example. As a result, according to this embodiment, the peripheries of the intake ports can be suppressed to be low in temperature compared to the comparative example and thus it is possible to form a state advantageous for suppression of knocking.

As shown in FIG. 9, in the operation example of this embodiment, the HT temperature is maintained at a temperature lower than the HT target temperature between time t92 and time t94. If the HT temperature has not reached the HT target temperature, the HT water flow amount due to the implementation of the HT cooling control becomes less compared to where the HT temperature has reached the HT target temperature (see arrow (A) shown in FIG. 9). If the HT water flow amount is small, the electric power consumption of the E-W/P 18 also becomes small. Therefore, according to this embodiment, part of an increase in electric power consumption caused by advancing the start of the LT cooling control can be compensated by electric power saving of the E-W/P 18 on the HT side.

Further, in this embodiment, as described above, the temperature of the peripheries of the intake ports can be maintained low over a long period of time in the warm-up process. In the internal combustion engine 10, as the temperature of the peripheries of the intake ports decreases, the charging efficiency of intake air can be increased. Therefore, according to the cooling device of this embodiment, the charging efficiency of intake air in the warm-up process can be increased compared to the comparative example (see arrow (B) shown in FIG. 9).

As described above, in the first embodiment of the invention, the circulation of the LT cooling medium is stopped during water flow restriction. However, the water flow restriction is satisfactory if it decreases the cooling capacity of the LT cooling system 30 compared to that when the LT cooling control is implemented, and thus is not limited to the technique described above. For example, it is possible to use as water flow restriction a technique that slightly circulates the LT cooling medium for the purpose of, e.g., system protection.

In the first embodiment described above, when neither the requirement for early warm-up nor the requirement for knock suppression is arising, "LT Temperature≥LT Determination Value" is always used as the LT cooling start condition, but the condition is not limited thereto. For example, similar to where knock suppression is required, "HT Temperature≥HT Determination Value" may also be used as the LT cooling start condition with respect to HT precedent, thereby suppressing thermal strain.

In the first embodiment described above, the water pump and the three-way valve of the HT cooling system 16 are both electrically controlled, but the configuration of embodiments of the invention is not limited thereto. That is, the E-W/P 18 may be a mechanical water pump driven by the driving torque of the internal combustion engine 10. Further, the three-way valve 28 may be replaced by a thermostat that switches between the flow passage passing through the HT radiator 22 and the flow passage bypassing the HT radiator 22 around the HT target temperature.

In the first embodiment described above, the LT cooling system 30 is configured to mainly cool the peripheries of the intake ports, but the configuration thereof is not limited thereto. Specifically, the LT cooling system may be the following. (1) A system that mainly cools the peripheries of intake valve insertion holes. (2) A system that mainly cools the peripheries of intake ports and the peripheries of intake valve insertion holes. (3) A system that mainly forms a water jacket for exhaust-side upper portions of cylinders. (4) A system that mainly cools the peripheries of intake ports and exhaust-side upper portions of cylinders. (5) A system that mainly cools the peripheries of intake valve insertion holes and exhaust-side upper portions of cylinders. (6) A system that mainly cools the peripheries of intake ports, the peripheries of intake valve insertion holes, and exhaust-side upper portions of cylinders.

In the first embodiment described above, the condition where neither the requirement for early warm-up nor the requirement for knock suppression is arising corresponds to a "specific condition" in claim 1.

Next, a second embodiment of the invention will be described with reference to FIGS. 10 to 12. A cooling device of this embodiment can be realized by causing the ECU 44 to implement a routine shown in FIG. 10A and FIG. 10B instead of the routine shown in FIG. 3A and FIG. 3B in the system of the first embodiment.

As described above, in the state where early warm-up of the internal combustion engine 10 is required, the cooling device of the first embodiment starts the LT cooling control always on the condition that "HT Temperature≥HT Determination Value" is established. Here, even if the LT temperature has reached an overheat region, the LT cooling control is not started unless the HT temperature reaches the HT determination value.

In the warm-up state where the HT temperature has not reached the HT determination value, even if the LT temperature rises to some extent, the operating state of the internal combustion engine 10 is not adversely affected to a large extent. However, if the LT temperature has entered the overheat region, a phenomenon that is unfavorable for the operation of the internal combustion engine 10, such as an occurrence of knocking or a decrease in charging efficiency, tends to occur. Therefore, in this second embodiment, even in the state where the early warm-up is required, when the LT temperature has reached a LT allowable limit (50° C. in this embodiment), the LT cooling control is started at that time point even if the HT temperature has not yet reached the HT determination value.

Figure 10A:
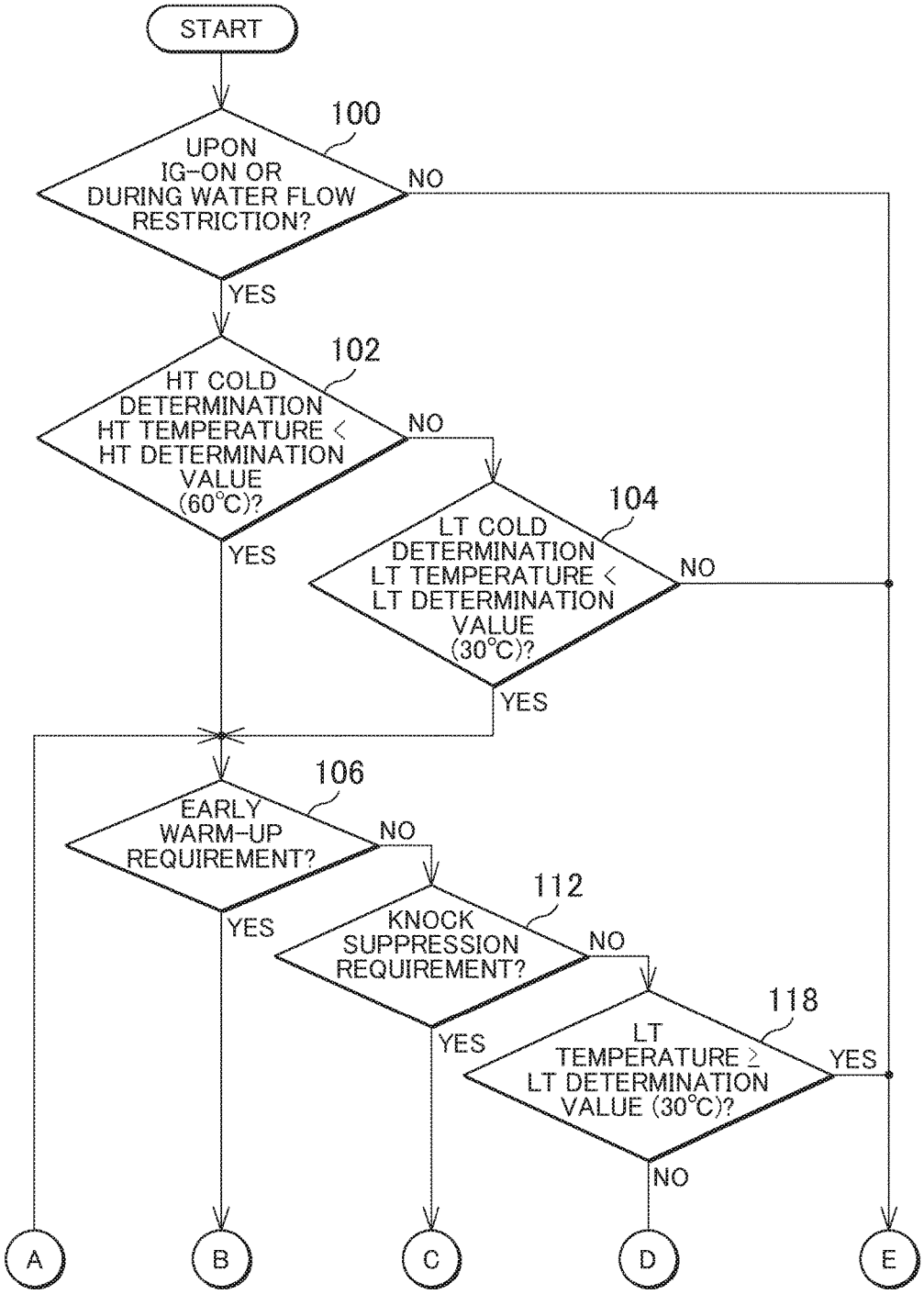
FIG. 10A and FIG. 10B are flowcharts of a routine implemented in a second embodiment of the invention.
Figure 10B:
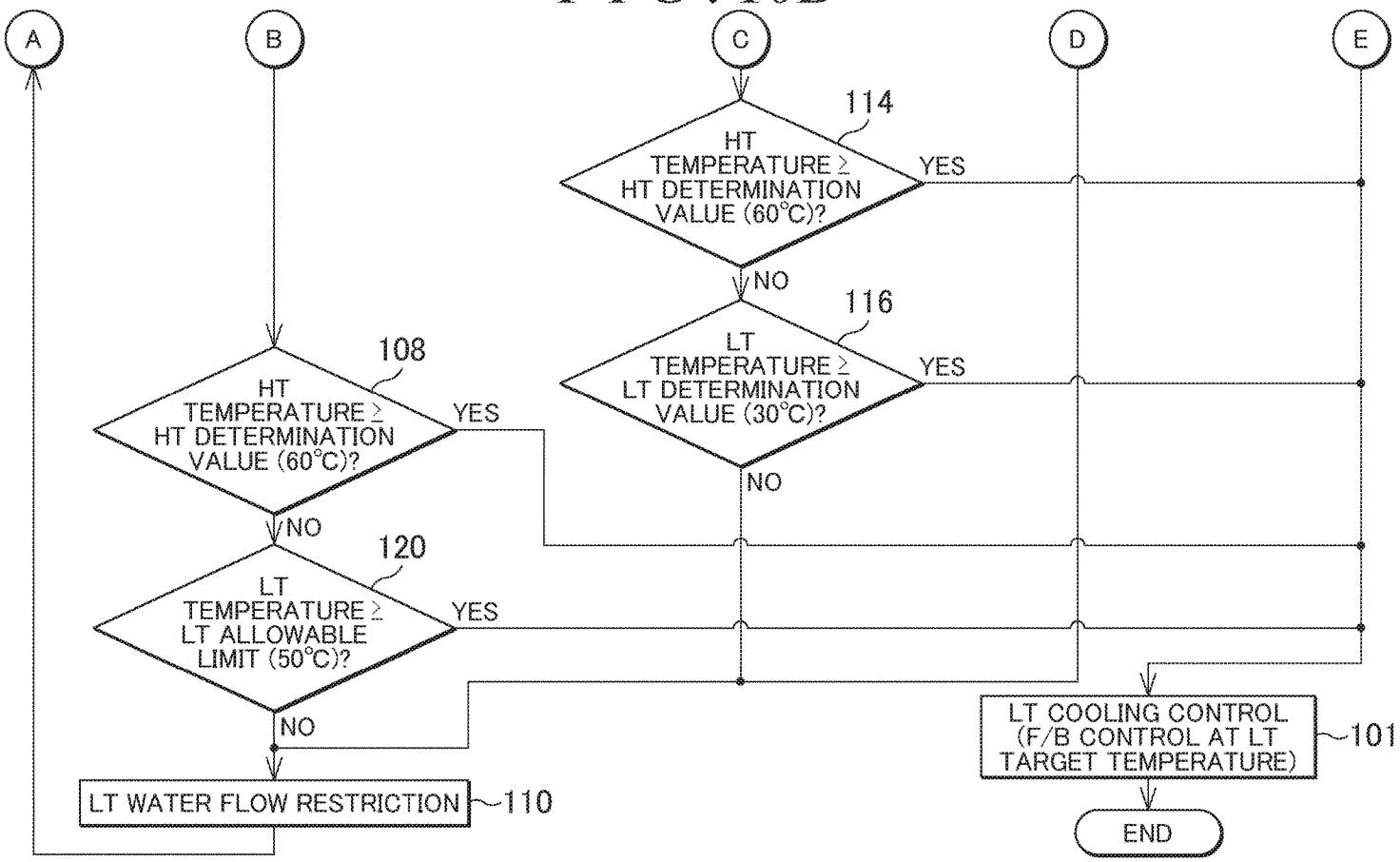

FIG. 10A and FIG. 10B are flowcharts of a routine implemented by the ECU 44 in this embodiment. The routine shown in FIG. 10A and FIG. 10B is the same as the routine shown in FIG. 3A and FIG. 3B except that step 120 is inserted between steps 108 and 110.

In the routine shown in FIG. 10A and FIG. 10B, if the requirement for early warm-up is confirmed at step 106, first, it is determined at step 108 whether or not "HT Temperature≥HT Determination Value" is established. If this condition is established, the LT cooling control is started promptly as with the first embodiment (step 101).

On the other hand, if the condition at step 108 is denied, then it is determined whether or not a second LT cooling start condition, i.e. "LT Temperature≥LT Allowable Limit", is established (step 120). If this condition is not established, it can be determined that the warm-up on the HT side has not progressed and that the LT side has not also reached the overheat region. Here, the water flow restriction of LT is maintained to respond to the requirement for early warm-up (step 110).

On the other hand, if the condition at step 120 is established, it is determined that although the early warm-up is required, it is necessary to prevent the heating of LT. If so, in this routine, the process of step 101 is implemented to start the LT cooling control promptly.

Figure 11:
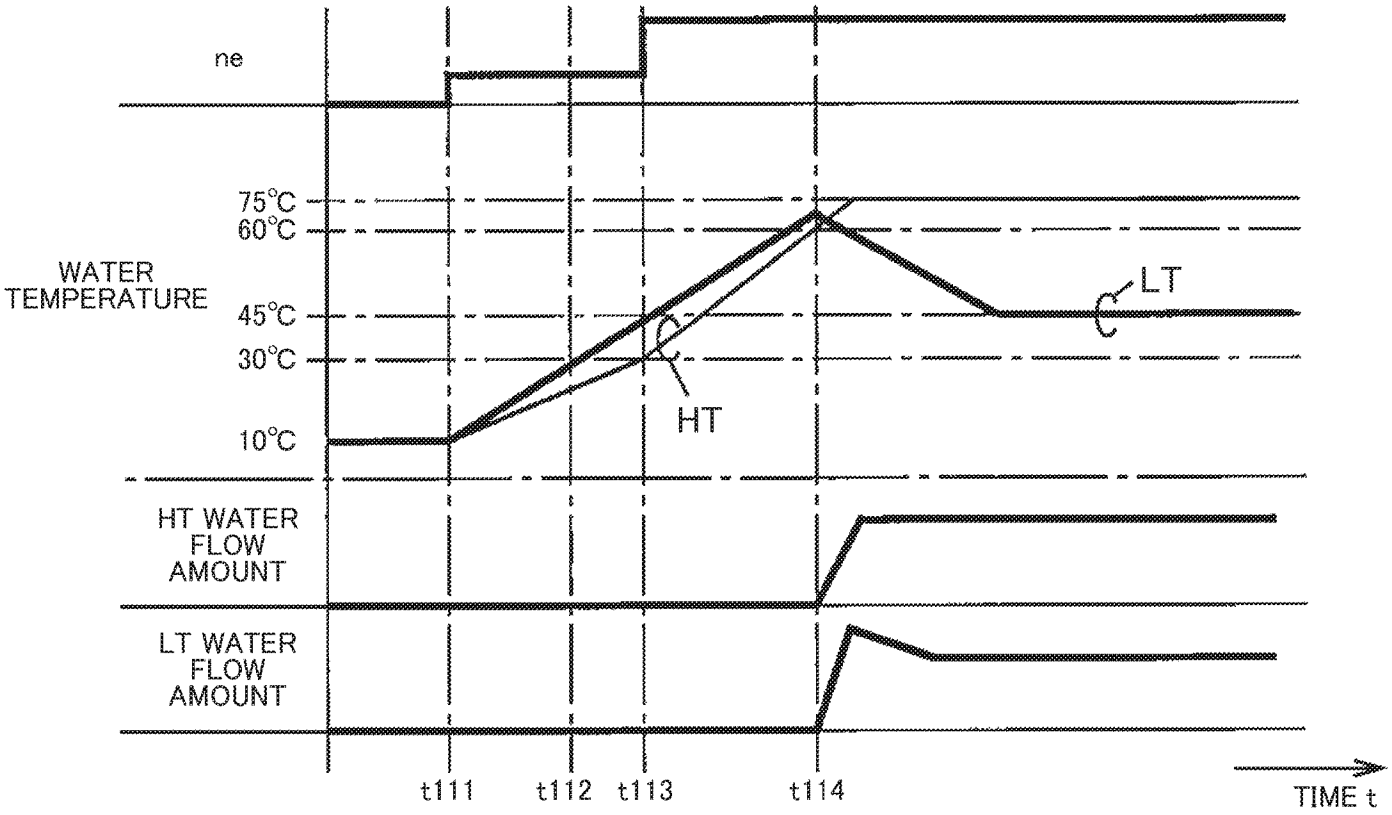
FIG. 11 is a timing chart for explaining one example of an operation realized by a cooling device of a comparative example under a condition where early warm-up is required.

FIG. 11 shows the operation of the first embodiment for comparison with the operation of this second embodiment. The operation shown in FIG. 11 occurs if the warm-up progresses under LT precedent under the requirement for early warm-up. In this example, after the internal combustion engine 10 is started at time t111, the warm-up progresses under LT precedent so that the LT temperature (thick line) has reached the LT determination value (30° C.) at time t112. In the first embodiment, "HT Temperature≥HT Determination Value" is always used as the LT cooling start condition under the requirement for early warm-up. Therefore, the LT cooling control is not started until time t114 at which the HT temperature (thin line) reaches the HT determination value (60° C.). As a result, the LT temperature once rises to the overheat region largely exceeding the LT target temperature (45° C.) and, after time t114, decreases toward that LT target temperature. In FIG. 11, for convenience' sake, there is shown a state in which the rise rate of the HT temperature increases following the acceleration after time t113. The LT target temperature is a temperature determined in consideration of the suppression of knocking and the charging efficiency of intake air. Therefore, if the LT temperature exceeds that target temperature, the adverse effects on knocking and charging efficiency inevitably occur.

Figure 12:
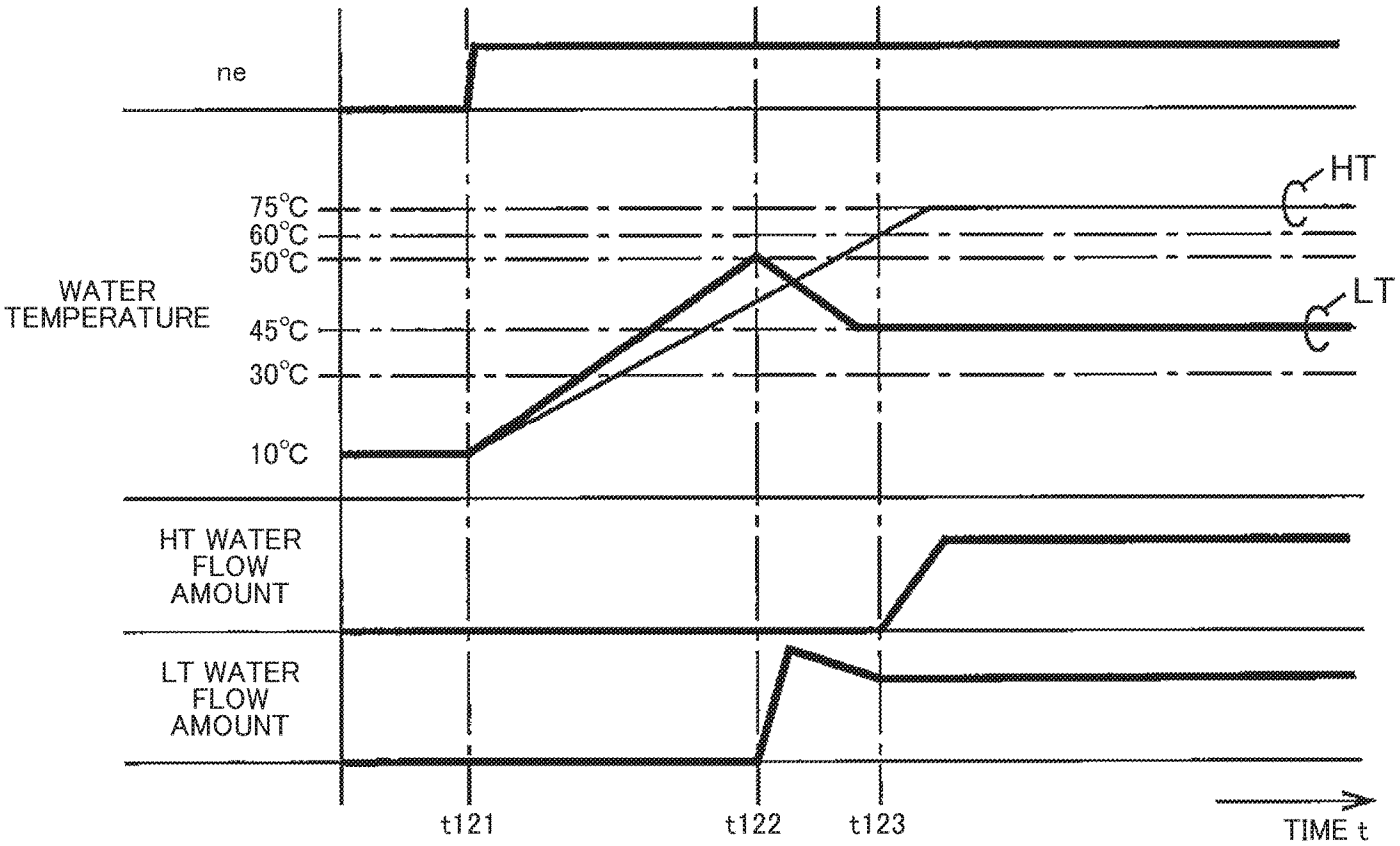
FIG. 12 is a timing chart for explaining one example of an operation realized by the second embodiment of the invention under a condition where early warm-up is required.

FIG. 12 shows an operation example of this second embodiment that occurs if the warm-up progresses under LT precedent under the requirement for early warm-up. As shown in FIG. 12, according to the cooling device of this embodiment, even in the state where the early warm-up is required, when the LT temperature has reached the LT allowable limit (50° C.) (time t122), the LT cooling control is started at that time point even if the HT temperature has not reached the HT determination value. As a result, after time t122, the LT temperature decreases toward the LT target temperature (45° C.). The rise rate of the HT temperature slightly decreases after time t122 due to the influence of the LT cooling control, but, since the LT temperature is in a high temperature region exceeding 45° C., the progress of the warm-up is not largely impeded. Therefore, according to this embodiment, the disadvantage due to the LT temperature overheat can be effectively avoided without largely impeding the promotion of the early warm-up.

Next, a third embodiment of the invention will be described with reference to FIGS. 13 and 14. A cooling device of this embodiment can be realized by causing the ECU 44 to implement a routine shown in FIG. 13A and FIG. 13B in the system shown in FIG. 1.

Even under the condition where the early warm-up is required, if the LT temperature has reached the LT allowable limit (50° C.), the cooling device of the second embodiment starts, at that time point, the LT cooling control, i.e. the control for decreasing the LT temperature to the LT target temperature (45° C.). In the meantime, the LT allowable limit is a temperature that can be allowed to the LT temperature in the warm-up process of the internal combustion engine 10. Therefore, in the environment where the HT temperature has not reached the HT determination value (60° C.), unless the LT temperature exceeds the LT allowable limit, a large disadvantage does not occur on the state of the internal combustion engine 10. That is, in the warm-up process of the internal combustion engine 10, it is sufficient to maintain the LT temperature at the LT allowable limit and there is no need to necessarily decrease the LT temperature to the LT target temperature.

The heat radiation amount for maintaining the LT temperature at the LT allowable limit (50° C.) is a small amount compared to the heat radiation amount for decreasing the LT temperature to the LT target temperature (45° C.). The heat radiation amount is preferably as small as possible in terms of promoting the early warm-up of the internal combustion engine 10. Therefore, if the LT temperature has reached the LT allowable limit under the condition where the early warm-up is required, the cooling device of this third embodiment thereafter implements not the control for decreasing the LT temperature to the LT target temperature (45° C.), but "LT Temperature Rise Prevention Control" for maintaining the LT temperature at the LT allowable limit (50° C.).

Figure 13A:
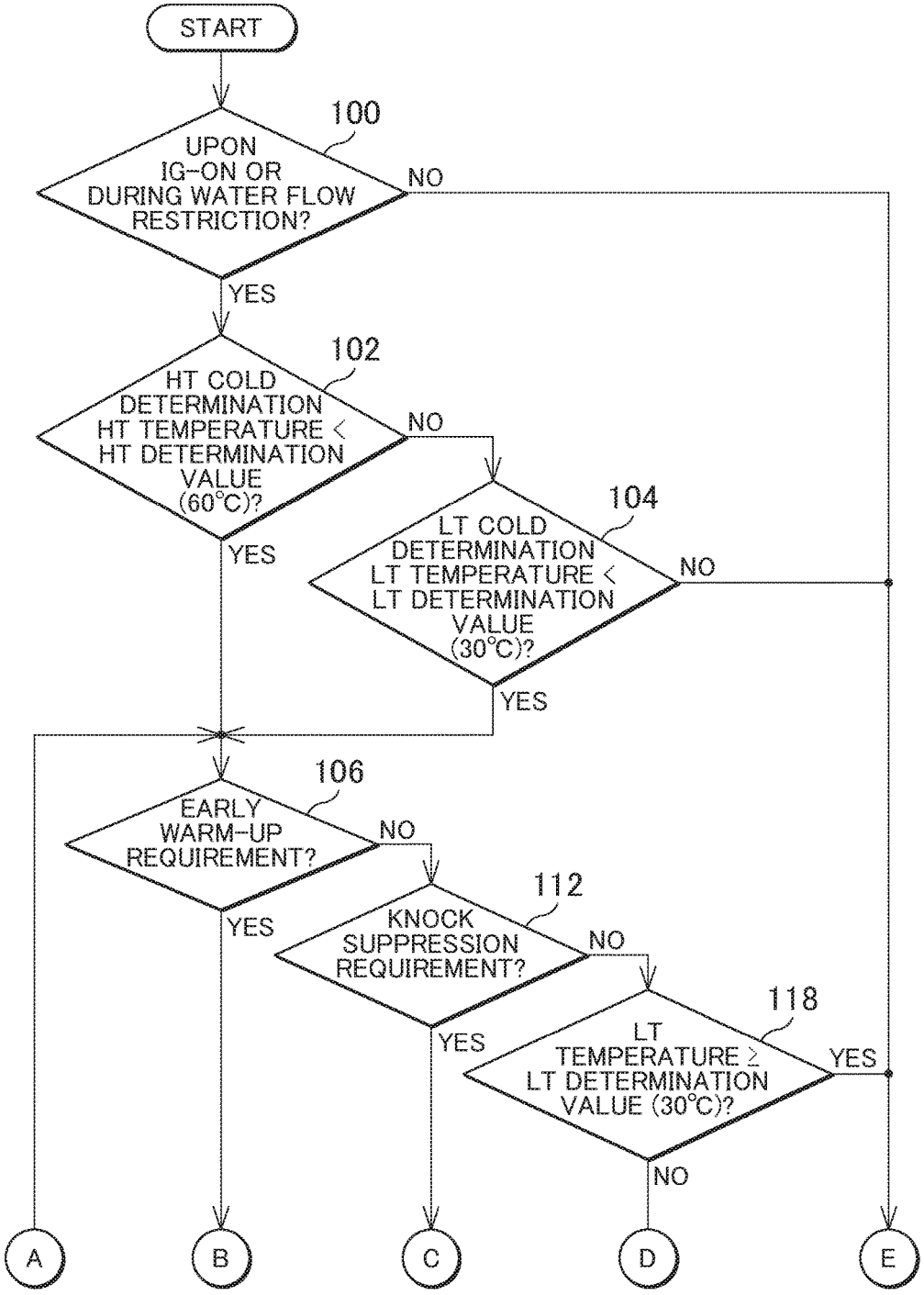
FIG. 13A and FIG. 13B are flowcharts of a routine implemented in a third embodiment of the invention.
Figure 13B:
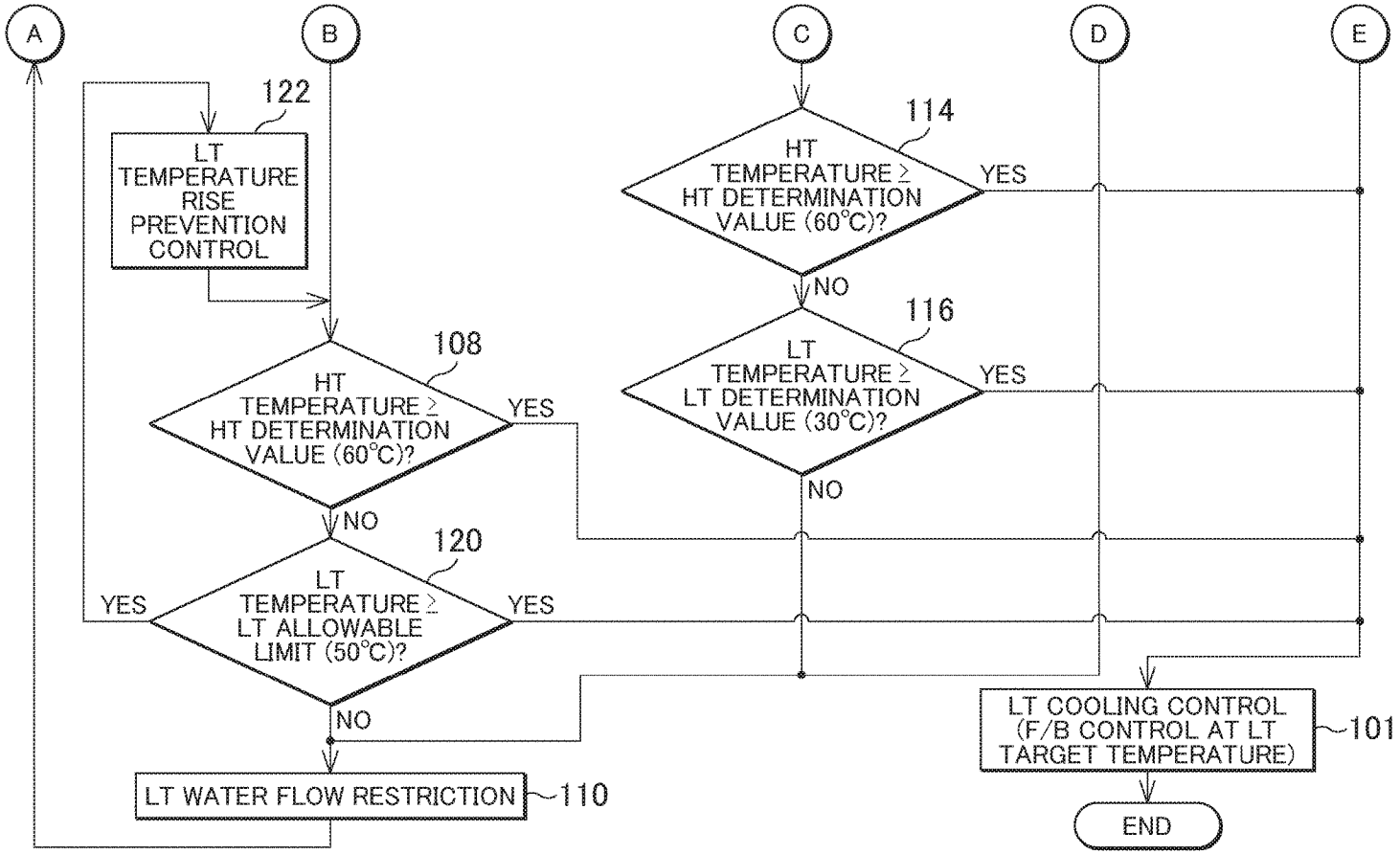

FIG. 13A and FIG. 13B are flowcharts of a routine that is implemented by the ECU 44 in this third embodiment to realize the function described above. The routine shown in FIG. 13A and FIG. 13B is the same as the routine shown in FIG. 10A and FIG. 10B except that step 122 is inserted on the Yes side of step 120.

In the routine shown in FIG. 13A and FIG. 13B, if it is determined at step 120 that "LT Temperature≥LT Allowable Limit" is established, then the LT temperature rise prevention control is started (step 122). Herein, specifically, based on an output of the LT temperature sensor 34, the LT cooling system 30 is controlled such that the LT temperature coincides with the LT allowable limit (50° C.).

After the process of step 122 is completed, the processes of step 108 and subsequent steps are implemented again. According to the flow of these processes, the LT temperature rise prevention control is implemented until the establishment of "HT Temperature≥HT Determination Value" is confirmed at step 108. If the condition at step 108 is established, the LT temperature rise prevention control is switched to the LT cooling control at that time point (step 101).

Figure 14:
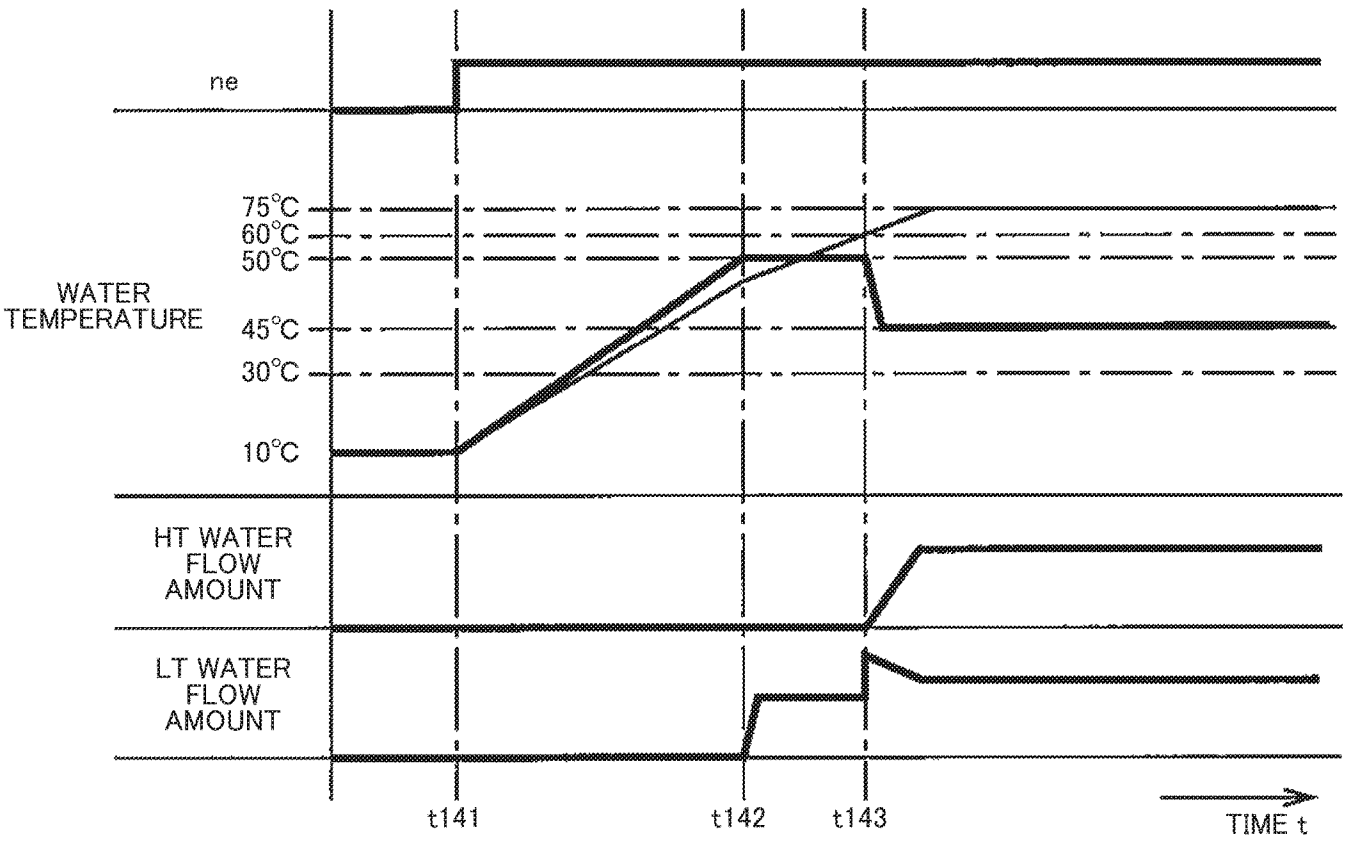
FIG. 14 is a timing chart for explaining one example of an operation realized by the third embodiment of the invention under a condition where early warm-up is required.

FIG. 14 shows an operation example of this embodiment as the warm-up progresses under LT precedent under the requirement for early warm-up. In the example shown in FIG. 14, after the internal combustion engine 10 is started at time t141, the LT temperature has reached the LT allowable limit (50° C.) at time t142 before the HT temperature reaches the HT determination value (60° C.). According to the routine shown in FIG. 13A and FIG. 13B, the LT temperature rise prevention control is started promptly thereafter and is continued until time t143 at which the HT temperature reaches the HT determination value. As a result, the LT temperature is maintained at the LT allowable limit (50° C.) between time t142 and time t143. Then, at time t143, the HT cooling control and the LT cooling control are started simultaneously and, thereafter, the HT temperature and the LT temperature reach the respective target temperatures (75° C. and 45° C.).

According to the operation described above, it is possible to surely avoid the LT temperature overheat under the condition where the early warm-up of the internal combustion engine 10 is required. Further, by minimizing the heat radiation amount on the LT side caused by that avoidance, it is possible to minimize a decrease in the rise rate of the HT temperature. Therefore, according to this embodiment, while effectively preventing overheating on the LT side as in the case of the second embodiment, it is possible to promote the early warm-up of the internal combustion engine 10 more efficiently than in the second embodiment.

Next, a fourth embodiment of the invention will be described with reference to FIG. 15A and FIG. 15B. A cooling device of this embodiment can be realized by causing the ECU 44 to implement a routine shown in FIG. 15A and FIG. 15B in the system shown in FIG. 1.

In the cooling devices of the first to third embodiments, the LT determination value is set to the temperature (30° C.) belonging to the boundary between the temperature region that prevents the occurrence of knocking and the temperature region in which there is a possibility of the occurrence of knocking. The LT determination value is the start temperature of the LT cooling control under the specific condition where the early warm-up requirement is not arising. Since the requirement for early warm-up is not arising, the necessity to consider the state of the HT side is low under this condition when determining the start of the LT cooling control. Assuming that only the suppression of knocking and the charging efficiency of intake air are the determination elements, the start time of the LT cooling control is preferably as early as possible.

In the state where the LT cooling medium is frozen, the LT cooling control should not be implemented in terms of protecting the LT cooling system 30. On the other hand, if the LT cooling medium is thawed, there is no reason to inhibit the start of the LT cooling control also in terms of system protection. In the system of this fourth embodiment, it is experimentally known that "−10° C." belongs to the boundary between a temperature region in which the LT cooling medium freezes and a temperature region in which the LT cooling medium does not freeze. Therefore, in this fourth embodiment, the LT determination value is decreased to "−10° C." from "30° C." in the first to third embodiments, thereby advancing the start time of the LT cooling control under the specific condition. Hereinafter, the LT determination value (−10° C.) used in this embodiment will be particularly referred to as a "LT thawing determination value".

Figure 15A:
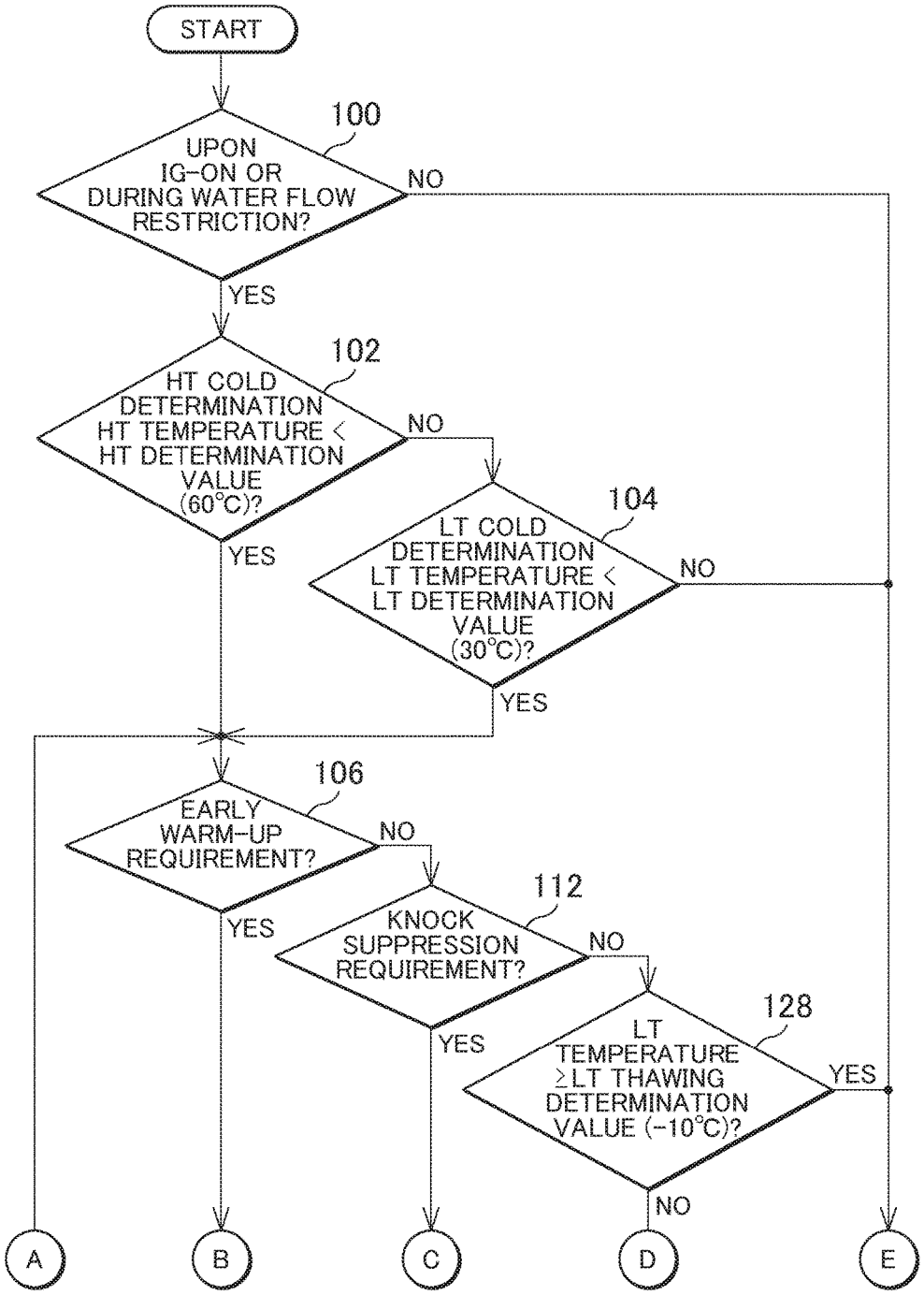
FIG. 15A and FIG. 15B are flowcharts of a routine implemented in a fourth embodiment of the invention.
Figure 15B:
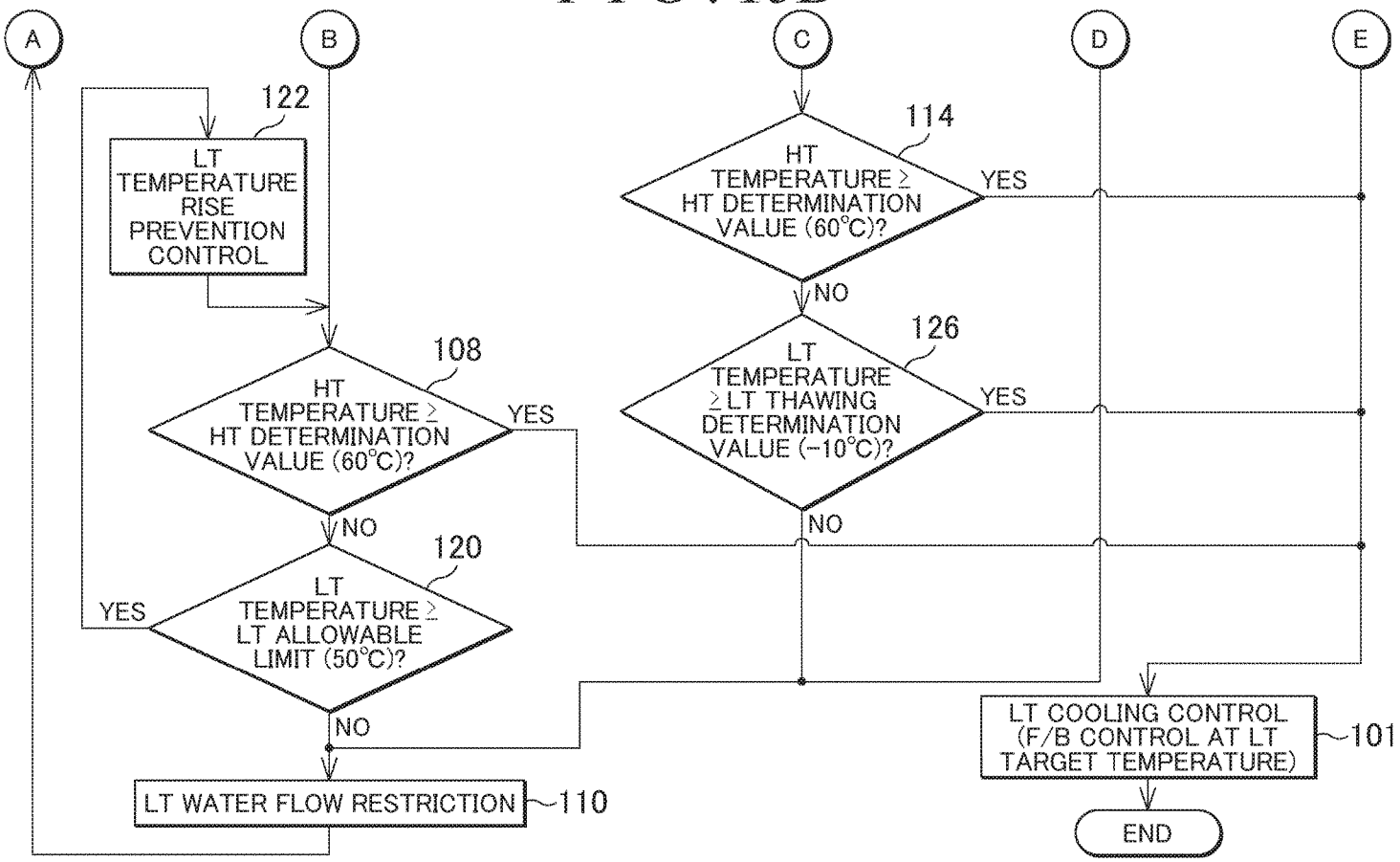

FIG. 15A and FIG. 15B are flowcharts of a routine implemented by the ECU 44 in this embodiment. The routine shown in FIG. 15A and FIG. 15B is the same as the routine shown in FIG. 13A and FIG. 13B except that step 116 is replaced by step 126 and that step 118 is replaced by step 128.

That is, in the routine shown in FIG. 15A and FIG. 15B, if the condition at step 114 is denied, it is determined whether or not "LT Temperature≥LT Thawing Determination Value (−10° C.)" is established as a LT cooling start condition (step 126). In this routine, if the condition at step 112 is denied, the same determination is carried out (step 128). If the start condition is denied at either step 114 or step 112, the LT water flow restriction is maintained in terms of system protection (see step 110). On the other hand, if the establishment of the condition is confirmed, the LT cooling control is started promptly (see step 101).

According to the processes described above, under the specific condition where the early warm-up is not required, the LT cooling control can be started while the temperature of the LT cooling medium is sufficiently low. As such, a period of time during which the LT temperature can be maintained low can be ensured to be long without conflicting with the requirement for warm-up of the internal combustion engine 10 at all. Therefore, according to the cooling device of this fourth embodiment, the characteristics further excellent in terms of an improvement in knock suppression and charging efficiency can be given to the internal combustion engine 10 compared to the devices of the first to third embodiments.

In the routine implemented in the fourth embodiment, steps 120 and 122 are included as in the routine shown in FIG. 13A and FIG. 13B. However, those steps are not essential elements of the invention. That is, as shown in FIG. 10A and FIG. 10B, step 122 may be omitted from the routine implemented in this embodiment. Further, as shown in FIG. 3A and FIG. 3B, steps 120 and 122 may be omitted from the routine implemented in this embodiment.

Next, a fifth embodiment of the invention will be described with reference to FIGS. 16 and 17. A cooling device of this embodiment can be realized by causing the ECU 44 to implement routines shown in FIGS. 16 and 17 in the system shown in FIG. 1.

In the cooling devices of the first to third embodiments, when the LT cooling start condition is not established, the water flow restriction is imposed on the LT cooling system 30 by stopping the E-W/P 32. In this fifth embodiment, desired water flow restriction is realized by guarding a parameter associated with the cooling capacity and used in the LT cooling control.

Figure 16:
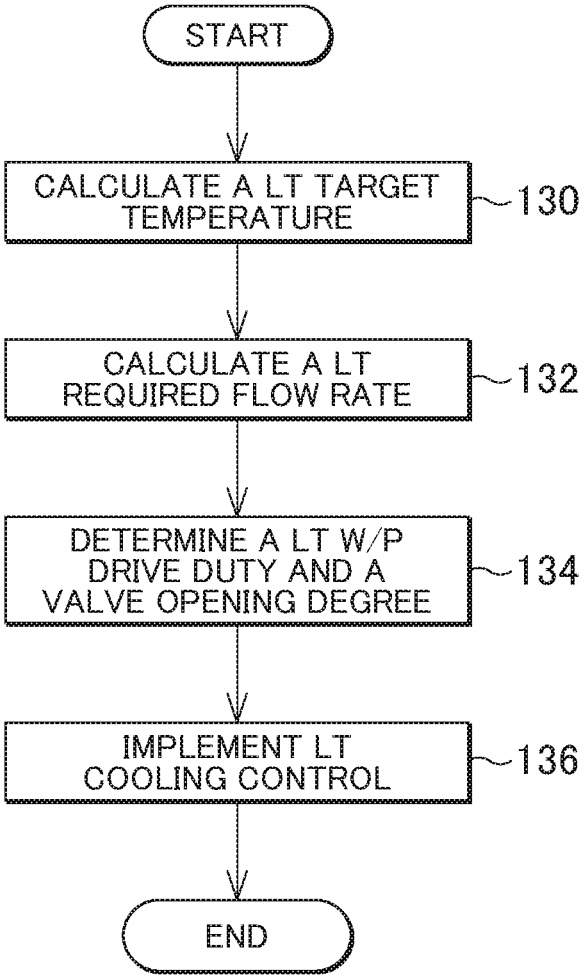
FIG. 16 is a flowchart of a first routine implemented in a fifth embodiment of the invention.

FIG. 16 is a flowchart of a main routine of the LT cooling control implemented by the ECU 44 in this embodiment. The routine shown in FIG. 16 is repeatedly run at an appropriate time interval after the start of the internal combustion engine 10.

When the routine shown in FIG. 16 is started, first, a LT target temperature is calculated (step 130). In this fifth embodiment, the LT target temperature is suitably set according to the operating state of the internal combustion engine 10 and the necessity of knock suppression. Various sensor signals necessary for that setting are supplied to the ECU 44 and various maps are stored in the ECU 44. Herein, the LT target temperature suitable for the current state is calculated according to those sensor signals and maps.

Then, a required flow rate of the LT cooling medium is calculated (step 132). The ECU 44 is storing a map for calculating, based on a current LT temperature, a required flow rate (the amount of the LT cooling medium that flows through the LT radiator 36) necessary for realizing a LT target temperature. Herein, the required flow rate of the LT cooling medium is calculated by applying a detection value of the LT temperature sensor 34 to that map.

Afterwards, control parameters of the LT cooling system 30, i.e. a drive duty of the E-W/P 32 and an opening degree of the three-way valve 42, are determined (step 134). The circulation amount of the LT cooling medium is determined by the drive duty of the E-W/P 32. Further, the cooling medium amount that flows through the LT radiator 36 is determined by that circulation amount and the opening degree of the three-way valve 42. A map determining the relationship therebetween is stored in the ECU 44. Herein, the drive duty of the E-W/P 32 and the opening degree of the three-way valve 42 for achieving the required flow rate are calculated according to that map.

Upon the completion of the processes described above, the LT cooling control is implemented according to the drive duty of the E-W/P 32 and the opening degree of the three-way valve 42 determined by those processes (step 136).

Figure 17A:
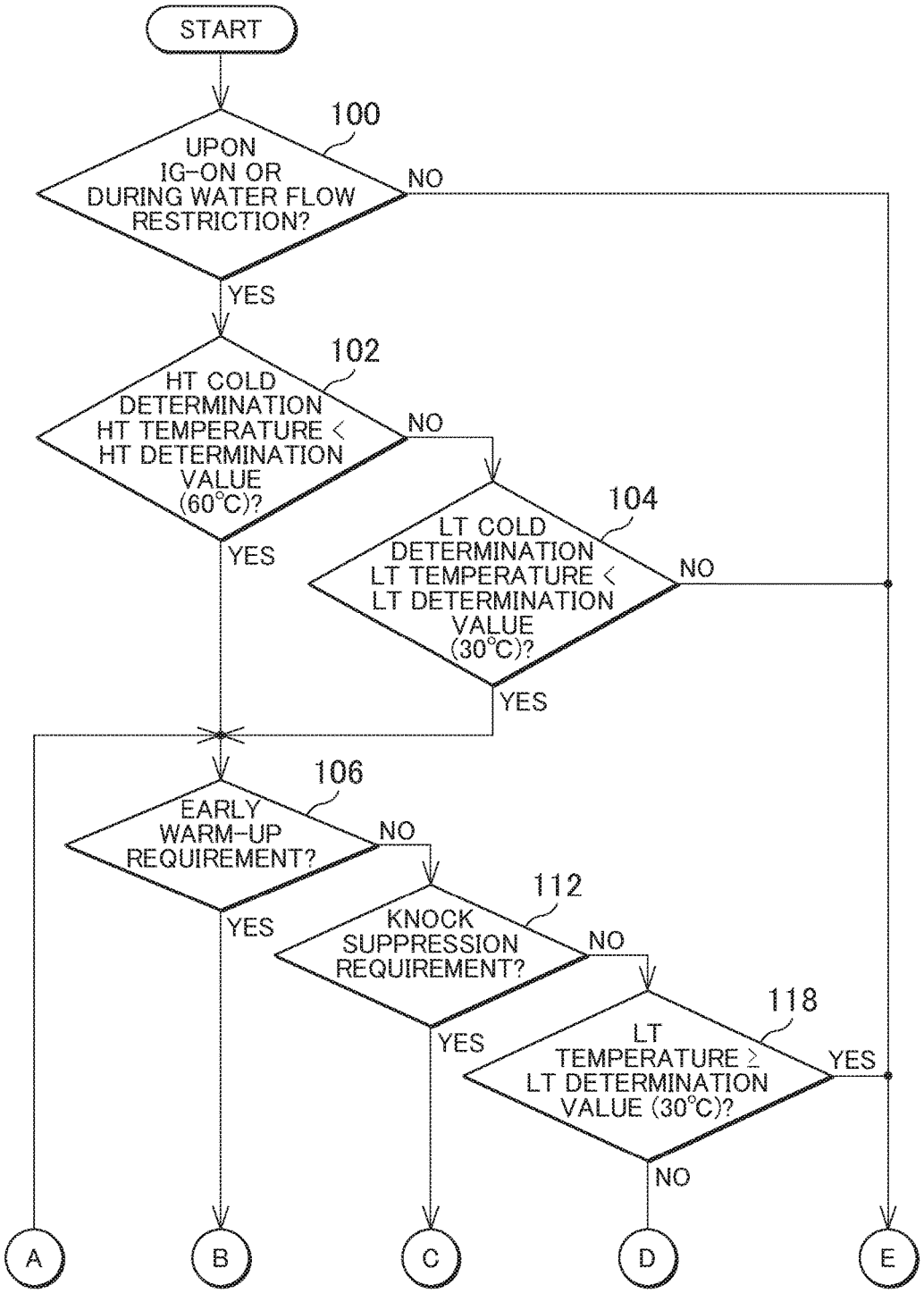
FIG. 17A and FIG. 17B are flowcharts of a second routine implemented in the fifth embodiment of the invention.
Figure 17B:
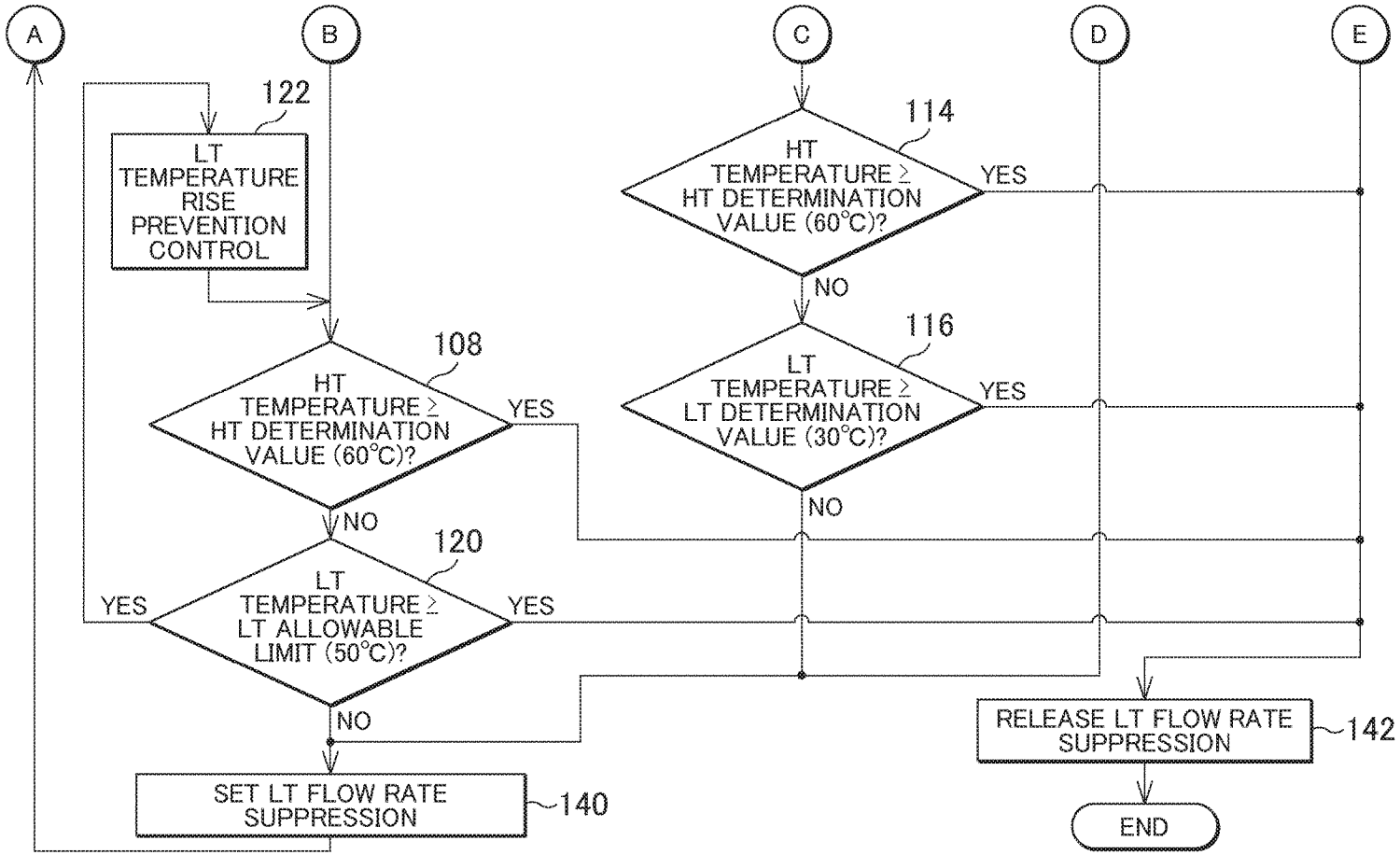

FIG. 17A and FIG. 17B are flowcharts of a routine that is implemented by the ECU 44 for realizing the water flow restriction on the LT side. The routine shown in FIG. 17A and FIG. 17B is the same as the routine shown in FIG. 13A and FIG. 13B except that step 110 is replaced by step 140 and that step 101 is replaced by step 142.

That is, in the routine shown in FIG. 17A and FIG. 17B, if the water flow restriction of LT is required, for example, if a No determination is made at step 120, setting for suppressing the LT flow rate is performed (step 140). As described above, in the main routine of the LT cooling control, the LT required flow rate for realizing the LT target temperature is calculated at step 132. At step 140, specifically, a guard value serving as an upper limit value of the LT required flow rate is set. At step 132 shown in FIG. 16, the LT required flow rate is set within the guard value set at step 140. When the LT required flow rate is limited to the guard value, the drive duty of the E-W/P 32 and the opening degree of the three-way valve 42 are also restricted by that guard value. As a result, the cooling capacity of the LT cooling system 30 is suppressed so that it is possible to satisfy the function of the water flow restriction.

In the routine shown in FIG. 17A and FIG. 17B, if the establishment of the LT cooling start condition is confirmed, for example, if a Yes determination is made at step 108, the suppression of the LT flow rate is released (step 142). That is, herein, the guard value imposed on the LT required flow rate is set to a maximum value allowed to the system. After the process of step 142 is implemented, the flow rate actually necessary for realizing the LT target temperature is calculated as a LT required flow rate substantially at step 132 shown in FIG. 16. As a result, the LT cooling control for causing the LT temperature to be at the LT target temperature is started.

As described above, according to the cooling device of this fifth embodiment, the function of the water flow restriction can be realized by setting the guard value to the control parameter used in the LT cooling control and further the desired LT cooling control can be realized by releasing that guard value. According to this technique, the state during the water flow restriction can be delicately controlled compared to the case where there is only on-off switching of the E-W/P 32. Therefore, according to this embodiment, more accurate temperature control can be implemented in the LT cooling system 30 compared to in the first to third embodiments.

In the fifth embodiment described above, the guard value for realizing the function of the water flow restriction is set to the LT required flow rate, but the guard value setting object is not limited thereto. For example, it may be configured that the guard value is not set to the LT required flow rate, but is set to the drive duty of the E-W/P 32 or the opening degree of the three-way valve 42, thereby realizing the same function.

In the fifth embodiment described above, the guard value for realizing the function of the water flow restriction is set as a fixed value, but the setting technique is not limited thereto. For example, the guard value may be set based on the LT temperature or the HT temperature.

What is claimed is:

1. A cooling device for an internal combustion engine, comprising:

a HT cooling system that mainly cools a cylinder block of the internal combustion engine;

a LT cooling system that mainly cools a periphery of an intake port compared to the HT cooling system, the LT cooling system and the HT cooling system having cooling medium flow passages independent of each other; and an electronic control unit configured to:

if a HT temperature being a temperature of a HT cooling medium flowing in the HT cooling system has reached a HT determination value, control an operation state of the HT cooling system to start cooling for maintaining the HT temperature at a HT target temperature;

in response to the electronic control unit determining that a specific condition is met, wherein the specific condition includes that warm up of the internal combustion engine is not required, and then determining that a LT temperature being a temperature of a LT cooling medium flowing in the LT cooling system has reached a LT determination value, start a LT cooling control for maintaining the LT temperature at a LT target temperature;

start the LT cooling control in response to the electronic control unit determining that early warm-up of the internal combustion engine is required and then determining that the HT temperature has reached the HT determination value.

2. The cooling device for the internal combustion engine according to claim 1, wherein the electronic control unit is configured to start the LT cooling control also if the LT temperature has reached a LT allowable limit and the early warm-up is required, the LT allowable limit being a temperature higher than the LT determination value.

3. The cooling device for the internal combustion engine according to claim 1, wherein the electronic control unit is configured to, if the LT temperature has reached a LT allowable limit before the HT temperature reaches the HT determination value and the early warm-up is required, implement a LT temperature rise prevention control for maintaining the LT temperature at the LT allowable limit until the HT temperature reaches the HT determination value, the LT allowable limit being a temperature higher than the LT determination value.

4. The cooling device for the internal combustion engine according to claim 1, wherein the specific condition further includes that knock suppression is not required.

5. The cooling device for the internal combustion engine according to claim 4, further comprising:

a knock control system configured to retard an ignition crank angle of the internal combustion engine in response to an occurrence of knocking.

6. The cooling device for an internal combustion engine according to claim 5, wherein the electronic control unit is configured to determine presence or absence of the requirement for the early warm-up prior to a determination about the presence or absence of the requirement for the knock suppression.

7. The cooling device for the internal combustion engine according to claim 1, wherein the LT determination value belongs to a boundary between a temperature region in which the LT cooling medium freezes and a temperature region in which the LT cooling medium does not freeze, and is a temperature less than or equal to 0° C.

8. The cooling device for the internal combustion engine according to claim 1, wherein the LT cooling system includes a LT temperature sensor that detects the LT temperature and a cooling mechanism that changes a cooling capacity of the LT cooling medium, the LT cooling control is a feedback control of the cooling mechanism based on an output of the LT temperature sensor, and the electronic control unit is configured to, before starting the LT cooling control, limit a circulation flow rate of the LT cooling medium compared to that during implementation of the feedback control.

9. The cooling device for the internal combustion engine according to claim 8, wherein the electronic control unit is configured to, before starting the LT cooling control, implement the feedback control by applying a guard for limiting the circulation flow rate of the LT cooling medium, to a parameter associated with the circulation flow rate of the LT cooling medium.

* * * * *